US009039428B2

(12) United States Patent
Sasaki et al.

(10) Patent No.: US 9,039,428 B2
(45) Date of Patent: May 26, 2015

(54) BOARD-TO-BOARD CONNECTOR

(75) Inventors: Kenta Sasaki, Ansan (KR); Masami Sasao, Machida (JP); Toru Suzuki, Yamato (JP); Kenta Amino, Yamato (JP); Jesse Darja, Yamato (JP); Taichi Taniguchi, Yamato (JP)

(73) Assignee: Molex Incorporated, Lisle, IL (US)

( * ) Notice: Subject to any disclaimer, the term of this patent is extended or adjusted under 35 U.S.C. 154(b) by 83 days.

(21) Appl. No.: 13/819,362

(22) PCT Filed: Sep. 8, 2011

(86) PCT No.: PCT/US2011/050771

§ 371 (c)(1),
(2), (4) Date: May 28, 2013

(87) PCT Pub. No.: WO2012/033881

PCT Pub. Date: Mar. 15, 2012

(65) Prior Publication Data

US 2013/0330943 A1 Dec. 12, 2013

(30) Foreign Application Priority Data

Sep. 8, 2010 (JP) ..... 2010-200916
Aug. 23, 2011 (JP) ..... 2011-181670

(51) Int. Cl.

| | |
|---|---|
| ***H01R 12/00*** | (2006.01) |
| ***H01R 12/71*** | (2011.01) |
| ***H01R 13/631*** | (2006.01) |
| *H01R 12/72* | (2011.01) |
| *H01R 12/73* | (2011.01) |
| *H01R 107/00* | (2006.01) |

(52) U.S. Cl.

CPC ..... *H01R 12/716* (2013.01); *H01R 12/721* (2013.01); *H01R 12/73* (2013.01); *H01R 13/631* (2013.01); *H01R 2107/00* (2013.01)

(58) Field of Classification Search

USPC ..... 439/74, 660, 81, 78, 83, 347–347

See application file for complete search history.

(56) References Cited

U.S. PATENT DOCUMENTS

| | | | | |
|---|---|---|---|---|
| 7,264,484 | B2 * | 9/2007 | Takano | 439/74 |
| 7,658,636 | B2 * | 2/2010 | Takeuchi et al. | 439/357 |
| 7,901,218 | B2 * | 3/2011 | Sato et al. | 439/74 |
| 7,985,099 | B2 * | 7/2011 | Wu | 439/626 |
| 8,342,875 | B2 * | 1/2013 | Takeuchi | 439/374 |
| 8,398,425 | B2 * | 3/2013 | Suzuki et al. | 439/374 |
| 2006/0276060 | A1 | 12/2006 | Takano | |
| 2010/0159717 | A1 | 6/2010 | Takeuchi | |

FOREIGN PATENT DOCUMENTS

| | | | |
|---|---|---|---|
| JP | 2008-084796 | A | 1/2008 |
| JP | 2010-015739 | A | 1/2010 |
| JP | 2010-097724 | A | 4/2010 |

OTHER PUBLICATIONS

International Search Report for PCT/US2011/050771.

* cited by examiner

*Primary Examiner* — Jean F Duverne

(57) ABSTRACT

A board-to-board connector is disclosed. The board-to-board connector comprises a first connector and a second connector. The first connector has first terminals and a first housing which has first fitting guide portions formed at both ends in the longitudinal direction of the first housing. The second connector has second terminals configured to make contact with the first terminals, and a second housing which has second fitting guide portions formed at both ends in the longitudinal direction of the second housing and configured to engage with the first fitting guide portions.

20 Claims, 20 Drawing Sheets

BOARD-TO-BOARD CONNECTOR

REFERENCE TO RELATED APPLICATIONS

The Present Disclosure claims priority to prior-filed Japanese Patent Application Nos. 2011-181670, entitled "Board-To-Board Connector," filed on 23 Aug. 2011 with the Japanese Patent Office (JPO); and 2010-200916, entitled "Board-To-Board Connector," filed on 8 Sep. 2010 also with the JPO. The contents of each of the aforementioned patent applications are fully incorporated in their entireties herein.

BACKGROUND OF THE PRESENT DISCLOSURE

The Present Disclosure relates, generally, to a board-to-board connector, and, more particularly, to a board-to-board connector with reinforcing brackets arranged in fitting guide portions of both ends of a first housing of a first connector into which a second housing of a second connector is inserted so that, during fitting, the fitting guide portions are not damaged.

Board-To-Board connectors have been used for electrically connecting a pair of parallel circuit boards to each other. Such a board-to-board connector is electrically attached to respective opposing surfaces of a pair of circuit boards. An example of a typical board-to-board connector is disclosed in Japanese Patent Application No. 2008-084796.

FIG. 20 is a perspective view of a conventional board-to-board connector, illustrating a state where one and the other connectors of the board-to-board connector are prepared for coming into engagement to be fitted together. Referring to FIG. 20, a first connector 801 is one of a pair composing a board-to-board connector, and is mounted on a surface of a non-illustrated first board. Moreover, a second connector 901 is the other of the pair composing the board-to-board connector, and is mounted on a surface of a non-illustrated second board. The first connector 801 has a first housing 811 and a plurality of first terminals 861 fitted on the first housing 811, and the second connector 901 has a second housing 911 and a plurality of second terminals 961 fitted on the second housing 911. In addition, tail portions 862, 962 of the first terminal 861 and the second terminal 961 are soldered to terminal connection pads of the first board and the second board, respectively. Moreover, a concave portion 812 for receiving the second housing 911 is formed in the first housing 811. When the first connector 801 and the second connector 901 are engaged together by fitting, the first board and the second board are electrically connected by the mutual contact of the corresponding first terminals 861 and second terminals 961.

However, in the above-mentioned conventional board-to-board connector, during fitting operation, the first housing 811 or the second housing 911 may receive damage, or may be broken. When fitting the first connector 801 mounted on the first board and the second connector 901 mounted on the second board, an operator cannot view the fitting faces of the first housing 811 and the second housing 911 and may have to perform fitting operation by groping, depending on a working condition. Since the miniaturization and the height lowering of board-to-board connectors are progressing in recent years especially, it is difficult for the operator to view the fitting faces of the first housing 811 and the second housing 911. In this case, the operator, sliding the fitting faces of the first housing 811 and the second housing 911 by groping, adjusts the position of the second housing 911 to the first housing 811, and makes the second housing 911 inserted in the concave portion 812 of the first housing 811.

Accordingly, in a state where the first housing 811 and the second housing 911 are not completely aligned with each other, a fitting direction force may be applied to the first housing 811 and the second housing 911. In this case, a part of the fitting face of the first housing 811 or the second housing 911 may receive a large thrust, then may get damaged or broken. Especially, since guide portions 821 formed at both ends in longitudinal direction of the first housing 811 are comparatively thin, they may be broken easily, when, for example, the ends in longitudinal direction of the second housing 911 abut aslant them.

SUMMARY OF THE PRESENT DISCLOSURE

Therefore, it is an object of the Present Disclosure to obviate the above-described problems encountered by the conventional board-to-board connector and to provide a board-to-board connector having such a configuration that reinforcing brackets are arranged in fitting guide portions of both ends in longitudinal direction of a first housing of a first connector into which a second housing of a second connector is inserted, so that, during fitting operation, the fitting guide portions in longitudinal direction of the first housing of the first connector may not get damaged or broken either. Accordingly, it is possible to provide good operability and high reliability for the board-to-board connector.

Therefore, in accordance with the Present Disclosure, a board-to-board connector is provided which comprises a first connector having first terminals, a first housing which has first fitting guide portions formed at both ends in the longitudinal direction of the first housing, a second connector having second terminals configured to make contact with the first terminals, and a second housing which has second fitting guide portions formed at both ends in the longitudinal direction of the second housing and configured to engaged with the first fitting guide portions.

In accordance with a further embodiment of the Present Disclosure, the board-to-board connector has such a configuration that the first fitting guide portions include concave portions into which the second fitting guide portion are inserted, and end wall portions extending in the thickness direction of the first housing, inside surfaces of the end wall portions define outside ends in the longitudinal direction of the first housing in the concave portions.

In accordance with a further embodiment of the Present Disclosure, the board-to-board connector has such a configuration that the first reinforcing brackets are provided with first fitting guide portions attached thereto.

In accordance with a further embodiment of the Present Disclosure, the board-to-board connector has such a configuration that each of the first reinforcing brackets includes a body portion extending in the width direction of the first housing, and board connection portions connected to the body portion and fixed to a board at its free end, the body portion includes a central portion which covers at least a part of fitting side face of the end wall portion, and a tongue piece portion which is connected to the central portion and covers at least a part of inside surface of the end wall portion.

In accordance with a further embodiment of the Present Disclosure, the board-to-board connector has such a configuration that the central portion of the first reinforcing bracket and the tongue piece portion extend in the mutually perpendicular directions.

In accordance with a further embodiment of the Present Disclosure, the board-to-board connector has such a configuration that the body portion has modulus of section of approximately L-shape.

In accordance with a further embodiment of the Present Disclosure, the board-to-board connector has such a configuration that the first reinforcing bracket includes holding portions connected to the body portion via corner portions which extend aslant toward the center in the longitudinal direction of the first housing from the central portion.

In accordance with a further embodiment of the Present Disclosure, the board-to-board connector has such a configuration that the holding portions extend in the thickness direction of the first housing, and are held by the first housing.

In accordance with a further embodiment of the Present Disclosure, the board-to-board connector has such a configuration that the board connection portions are connected to one-ends of the holding portions.

In accordance with a further embodiment of the Present Disclosure, the board-to-board connector has such a configuration that each of the first terminals includes a tail portion connected to a conductive trace of the board.

In accordance with a further embodiment of the Present Disclosure, the board-to-board connector has such a configuration that each of the board connection portions of the first reinforcing brackets is configured so as to be aligned in a straight line with a plurality of the tail portions.

In accordance with a further embodiment of the Present Disclosure, the board-to-board connector has such a configuration that each of the first reinforcing brackets includes a slope portion formed in connection section between the central section and the tongue piece portion.

In accordance with a further embodiment of the Present Disclosure, the board-to-board connector has such a configuration that each of the first reinforcing brackets includes a first locking portion formed in the tongue piece portion.

In accordance with a further embodiment of the Present Disclosure, the board-to-board connector has such a configuration that each of the second reinforcing brackets is provided with a second fitting guide portion attached thereto.

In accordance with a further embodiment of the Present Disclosure, the board-to-board connector has such a configuration that the second reinforcing bracket includes a tongue piece portion which covers at least a part of outside surfaces of the second fitting guide portion and a second locking portion which is formed on the tongue piece portion.

In accordance with a further embodiment of the Present Disclosure, the board-to-board connector has such a configuration that, in a state where the engagement between the first connector and the second connector has been finished, the first locking portion and the second locking portion engage each other.

In accordance with a further embodiment of the Present Disclosure, the board-to-board connector has such a configuration that in a state where the engagement between the first connector and the second connector has been finished, clearance exists between the first reinforcing bracket and the second reinforcing bracket.

In accordance with a further embodiment of the Present Disclosure, the board-to-board connector has such a configuration that in a state where the engagement between the first connector and the second connector has been finished, the first locking portion and the second locking portion abut each other.

In accordance with a further embodiment of the Present Disclosure, the board-to-board connector has such a configuration that either one of the first locking portion and the second locking portion is convex, and the other one is concave.

In accordance with a further embodiment of the Present Disclosure, the board-to-board connector has such a configuration that the reinforcing brackets are arranged in the fitting guide portions of both ends in longitudinal direction of the first housing of the first connector into which the second housing of the second connector is inserted. Owing to such a configuration, during fitting operation, the fitting guide portions in longitudinal direction of the first housing of the first connector may not get damaged or broken either. Accordingly, the board-to-board connector has good operability.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which:

FIGS. 1A-B are perspective views of a first connector according to a first embodiment of the Present Disclosure, in which FIG. 1A is viewed from a fitting face thereof and FIG. 1B is viewed from a mounting surface thereof;

FIGS. 3A-B are perspective views of the connector of FIG. 1A and a second connector, according to the first embodiment of the Present Disclosure, illustrating a state where the connectors are engaged together, in which FIG. 3A is a diagram viewed from the fitting face of the first connector and FIG. 3B is a diagram viewed from the mounting surface of the first connector;

FIGS. 5A-B are perspective views of the second connector of FIG. 3, in which FIG. 5A is viewed from a fitting face thereof and FIG. 5B is viewed from a mounting surface thereof;

FIGS. 9A-B are perspective views of a connector according to a second embodiment of the Present Disclosure, in which FIG. 9A is viewed from a fitting face thereof and FIG. 9B is viewed from a mounting surface thereof;

FIGS. 11A-B are perspective views of the first connector of FIG. 9A and a second connector, according to the second embodiment of the Present Disclosure, illustrating a state where the connectors are engaged together, in which FIG. 11A is viewed from the fitting face of the first connector and FIG. 11B is viewed from the mounting surface of the first connector;

FIGS. 12A-B are perspective views of the second connector of FIG. 11, in which FIG. 12A is viewed from a fitting face thereof and FIG. 12B is viewed from a mounting surface thereof;

FIGS. 15A-B are perspective views of a connector according to a third embodiment of the Present Disclosure, in which FIG. 15A is viewed from a fitting face thereof and FIG. 15B is viewed from a mounting surface thereof;

FIGS. 17A-B are perspective views of the first connector of FIG. 15A and a second connector, according to the third embodiment of the Present Disclosure, illustrating a state where the connectors are engaged together, in which FIG. 17A is viewed from the fitting face of the first connector and FIG. 17B is viewed from the mounting surface of the first connector;

FIGS. 18A-B are perspective views of the second connector of FIG. 17, in which FIG. 18A is viewed from a fitting face thereof and FIG. 18B is viewed from a mounting surface thereof;

DESCRIPTION OF THE PREFERRED EMBODIMENTS

Figure 1A:
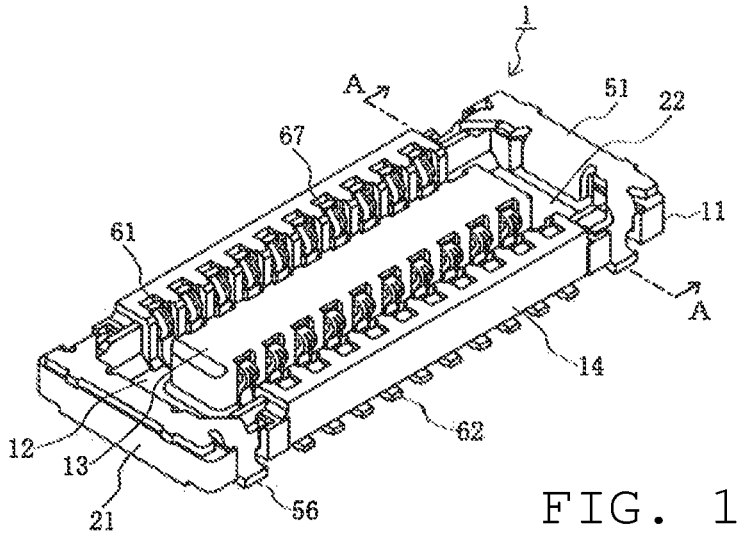
Figure 1B:
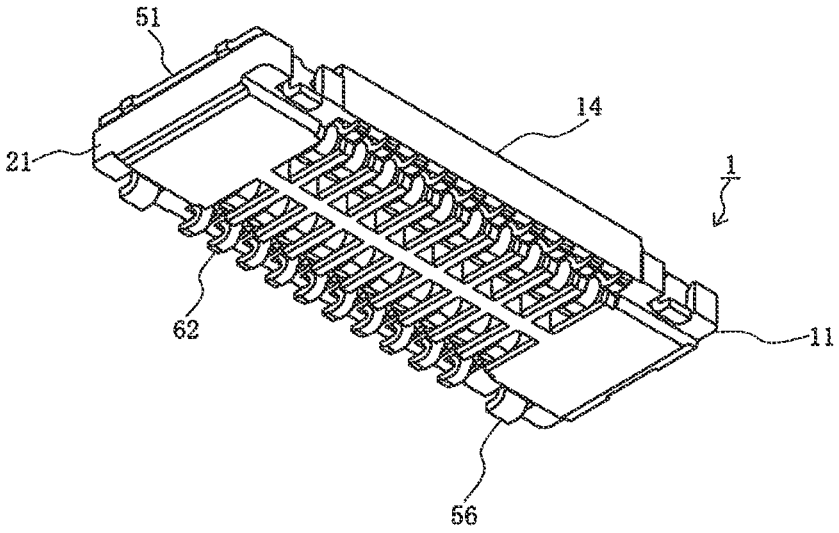

While the Present Disclosure may be susceptible to embodiment in different forms, there is shown in the Figures, and will be described herein in detail, specific embodiments, with the understanding that the disclosure is to be considered an exemplification of the principles of the Present Disclosure, and is not intended to limit the Present Disclosure to that as illustrated.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

In the drawing figures, a first connector, generally designated by reference numeral 1, as one of a pair comprising a board-to-board connector according to the present embodiment, is a surface-mounted type connector, which is mounted on a surface of a non-illustrated first board. Moreover, a second connector, as the other of the pair comprising the board-to-board connector, i.e., a counterpart connector, according to the present embodiment generally designated by reference numeral 101, is a surface-mounted type connector, which is mounted on a surface of a non-illustrated second board. The board-to-board connector according to the present embodiment includes the first connector 1 and the second connector 101, and is configured to electrically connect the first board and the second board with each other. Here, the first board and the second board are for example printed circuit boards, flexible flat cable, flexible printed circuit, and the like, used in an electronic device or apparatus, and may be any type of board.

Figure 2:
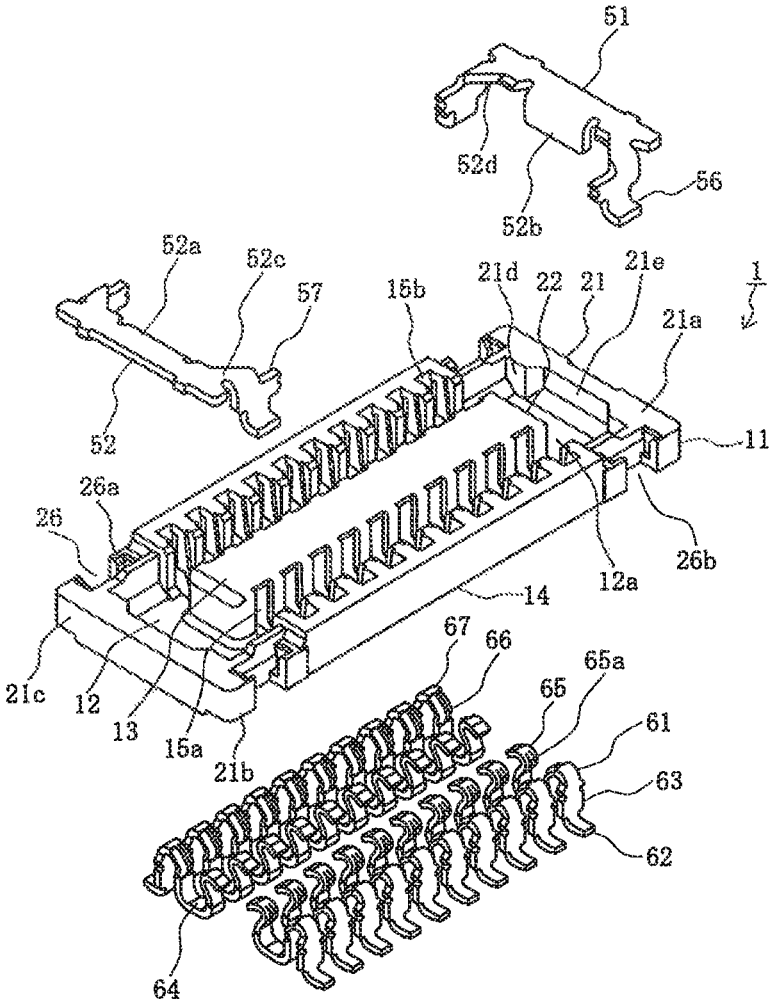
FIG. 2 is an exploded view of the connector of FIG. 1A.
Figure 3A:
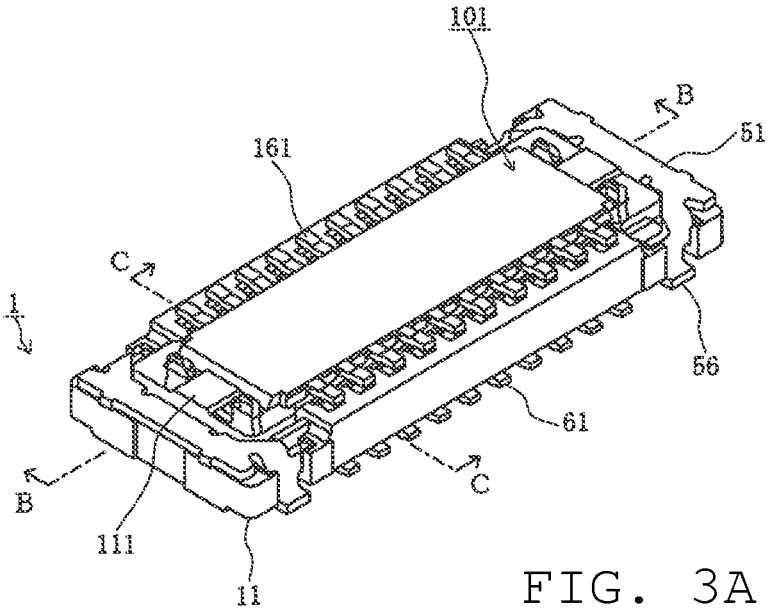
Figure 3B:
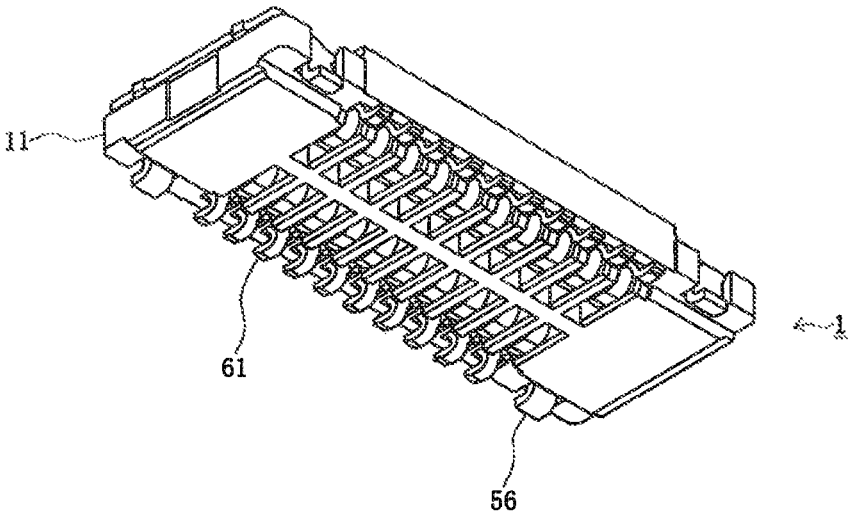
Figure 4:
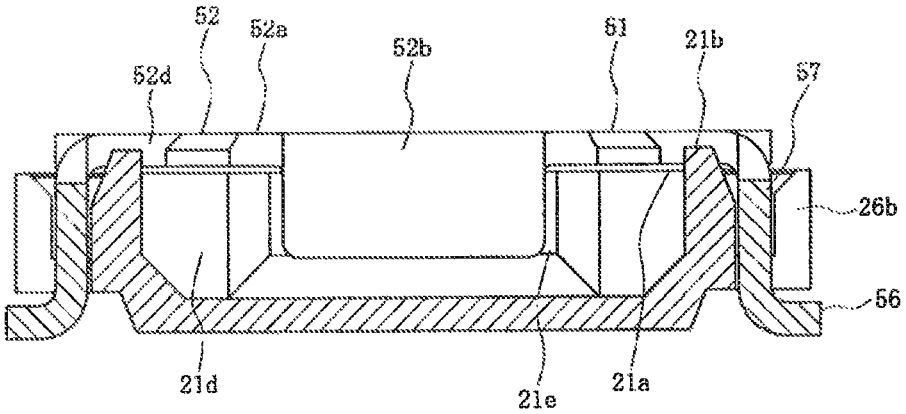
FIG. 4 is a sectional side view of the connector of FIG. 1A, taken along the Arrow A-A.

The first connector 1 includes a first housing 11 as a connector body integrally formed of an insulating material such as synthetic resin. As will be understood from the drawing figures, the first housing 11 is a generally rectangular parallelepiped member having a generally rectangular, thick plate-like shape. A concave portion 12 having a generally rectangular shape having a surrounded perimeter is formed on a side, i.e., a fitting face side (the upper side in FIG. 2), where the second connector 101 is fitted. The first connector 1 has a dimension of about 10.0 mm in length, about 2.5 mm in width, and about 1.0 mm in thickness, and the dimension may be appropriately changed. Moreover, a first protrusive convex portion 13 as an island portion is formed in the concave portion 12 to be integral with the first housing 11. Furthermore, side wall portions 14 configured to extend in parallel to the first protrusive convex portion 13 are formed at both sides of the first protrusive convex portion 13 to be integral with the first housing 11. In this case, the first protrusive convex portion 13 and the side wall portions 14 protrude upwardly from the bottom surface of the concave portion 12 and extend in the longitudinal direction of the first housing 11. Owing to this configuration, recessed groove portions 12*a*, as a portion of the concave portion 12, being elongated concave portions configured to extend in the longitudinal direction of the first housing 11 are formed at both sides of the first protrusive convex portion 13 to be disposed between the first protrusive convex portion 13 and the side wall portions 14. Although in the example illustrated in the drawing figures, the first protrusive convex portion 13 is singular in number, a plurality of first protrusive convex portions 13 may be provided and the number thereof is not particularly limited. In addition, the first protrusive convex portion 13 has a dimension of about 0.6 mm in width, for example, the dimension may be appropriately changed.

In the present embodiment, first terminal-receiving inside cavities 15*a* having a recessed groove shape each are formed on both side surfaces of the first protrusive convex portion 13. Moreover, first terminal-receiving outside cavities 15*b* having a recessed groove shape each are formed on inner side surface of the side wall portion 14. Since the first terminal-receiving inside cavities 15*a* and the first terminal-receiving outside cavities 15*b* are connected with each other at a bottom surface of the recessed groove portion 12*a* and are integral with each other, the first terminal-receiving inside cavities 15*a* and the first terminal-receiving outside cavities 15*b* will be collectively referred to as first terminal receiving cavities 15.

The number of first terminal receiving cavities 15 on each side of the first protrusive convex portion 13 is 10 with a pitch of about 0.4 mm, for example. Moreover, the number of first terminals 61 received in the first terminal receiving cavities 15 on each side of the first protrusive convex portion 13 is 10 with a pitch of about 0.4 mm, for example. It should be appreciated that the pitch and the number of the first terminal receiving cavities 15 may be appropriately changed as required.

The first terminals 61 are an integral member formed, by applying e.g., punching and bending to a conductive metallic plate. Each of the first terminals 61 is provided with a holding portion 63, a tail portion 62 connected to a lower end of the holding portion 63, an upper connection portion 67 connected to an upper end of the holding portion 63, a second contact portion 66 as a second contacting convex portion formed in the vicinity of an inner end of the upper connection portion 67, a lower connection portion 64 connected to the second contact portion 66, a first contact portion 65 formed in the vicinity of a free end of the lower connection portion 64, and a first contacting convex portion 65*a* formed on the first contact portion 65.

The holding portions 63 are portions that extend in the up-down direction, i.e., in the thickness direction of the first housing 11 to be held by being fitted in the first terminal-receiving outside cavities 15*b*. The tail portions 62 are bent to be connected to the holding portions 63 and extend in the left-right direction, i.e., outwardly in the width direction of the first housing 11 to be connected to terminal connection pads connected to a conductive trace on the first board by means of soldering or the like. The upper connection portions 67 are bent to be connected to the holding portions 63 and extend inwardly in the width direction of the first housing 11.

The second contact portions 66 having a curved shape and configured to downwardly bend and protrude toward the inner side in the width direction of the first housing 11 are formed at the inner ends of the upper connection portions 67. The lower connection portions 64 are portions, which have a generally U shape in side view, are connected to the lower ends of the second contact portions 66. Furthermore, the first contact portions 65 having a curved shape and configured to bend in an U shape and outwardly protrude in the width direction of the first housing 11 are formed at the free ends, i.e., in the vicinity of the inner upper ends of the lower connection portions 64.

The first terminals 61 are fitted into the first terminal receiving cavities 15 from the mounting face side (the lower side in FIG. 2) to be fixedly secured to the first housing 11 when the holding portions 63 are clamped by the side walls of the first terminal-receiving outside cavities 15*b* in a sandwich manner, which are formed in inside surface of the side wall portions 14. In this state, that is, a state where the first terminals 61 are mounted in the first housing 11, the first contact portions 65 and the second contact portions 66 are positioned on both left and right sides of the recessed groove portion 12*a* so as to oppose each other.

Since each of the first terminals 61 is an integral member formed by applying processing to a metal plate, they have some degree of elasticity. Moreover, as is obvious from the shape of the first terminals 61, the gap between the opposing ones of the first contact portions 65 and the second contact portions 66 is elastically changeable. That is, when the second terminals 161 of the second connector 101 are inserted to be positioned between the first contact portions 65 and the second contact portions 66, the gap between the first contact portions 65 and the second contact portions 66 is elastically increased.

Furthermore, first protrusive end portions 21 as a first fitting guide portion are arranged at both ends in the longitudinal direction of the first housing 11, respectively. A concave protrusive end portion 22 as a portion of the concave portion 12 is formed in each of the first protrusive end portions 21. The concave protrusive end portions 22 are generally rectangular concave portions and are connected to both ends in the longitudinal direction of each of the recessed groove portions 12*a*. Moreover, the concave protrusive end portion 22 functions as a concave insertion portion in which a later-described second protrusive end portion 122 of the second connector 101 is inserted in a state where the first connector 1 and the second connector 101 are engaged by fitting together.

Each of the first protrusive end portions 21 is provided with sidewall extension portions 21*b* configured to extend in the longitudinal direction of the first housing 11 from both ends in the longitudinal direction of the side wall portion 14 and an end wall portion 21*c* configured to extend in the short-axis direction of the first housing 11 and having both ends thereof connected to the sidewall extension portions 21*b*. In each of the first protrusive end portions 21, the end wall portion 21*c* and the sidewall extension portions 21*b* connected to both ends of the end wall portion 21*c* form a continuous side wall having an inverted C shape to thereby define three sides of the rectangular concave protrusive end portion 22.

Furthermore, first reinforcing brackets 51 as reinforcing brackets are attached to the first protrusive end portions 21. The first reinforcing brackets 51 are arranged so that at least a part of the upper surface 21*a* as the fitting side face of the end wall portion 21*c* may be covered, and are received and held in first concave bracket holding portions 26 formed in the sidewall extension portions 21*b* of the first protrusive end portions 21.

In the present embodiment, the first reinforcing bracket 51 is an integral member formed by applying processing, e.g., punching and bending, to a metal plate (for example, about 1.0 mm in thickness). Each of the first reinforcing brackets 51 is provided with a first body portion 52 as a body portion, which is configured to extend in the width direction of the first housing 11, first arm portions 57 as holding portions, which are configured to bend to be connected to both left and right ends of the first body portion 52 and extend in the thickness direction of the first housing 11 (the up-down direction in FIG. 2) to be held in the first housing 11, and first board connection portions 56 as board connection portions, which are connected to lower ends of the first arm portions 57.

Furthermore, each of the first body portions 52 is provided with a central portion 52*a*, which, having a generally elongated strip shape, is configured to extend linearly in the width direction of the first housing 11 and in parallel to the fitting face of the first housing 11, a tongue piece portion 52*b*, which is configured to extend from an inside edge (the edge facing to the center in the longitudinal direction of the first housing 11) in a center part of the central portion 52*a* downwardly, i.e., directing to a mounting face, and corner portions 52*c*, each of which is configured to extend aslant toward the center in the longitudinal direction of the first housing 11 from the vicinity of each end of the central portion 52*a*.

Typically, the central portion 52*a* is formed into a shape and a size enough to cover whole the upper surface 21*a* of the end wall portion 21*c* and is arranged so that it may cover whole the upper surface 21*a*. Though, it is not necessarily needed to cover whole the upper surface 21*a* but it might cover just a part of the upper surface 21*a*.

The tongue piece portion 52*b* has an upper end bent to be connected to the upper surface 21*a*, and is configured to extend in the thickness direction of the first housing 11 and is arranged so as to cover at least a part of inside surface 21*d* (the edge facing to the center in the longitudinal direction of the first housing 11) of the end wall portion 21*c*. Although, in the depicted example, the tongue piece portion 52*b* is received in a concave portion 21*e* formed in the inside surface 21*d* of the end wall portion 21*c* and is formed so as to be substantially flash with the inside surface 21*d* positioned in both sides of the concave portion 21*e*, the concave portion 21*e* may not necessarily be formed for receiving the tongue piece portion 52*b*. The tongue piece portion 52*b* may cover whole the inside surface 21*d*.

Each of the corner portions 52*c* extends in the same flat surface as the central portion 52*a*, and a tip thereof is connected to an upper end of the first arm 57. An inside edge of the each corner portion 52*c* comprises a diagonal edge 52*d* slanting to the longitudinal and width directions of the first housing 11. The diagonal edges 52*d* are positioned in both corners of outside edges (the edges facing to the longitudinal direction of the first housing 11) of the concave protrusive end portions 22, and could function as guide portions for guiding the second protrusive end portions 122 into the concave protrusive end portions 22 when the second protrusive end portions 122 of the second connector 101 is inserted in the concave protrusive end portions 22. And, strength of the first reinforcing brackets 51 would be reinforced by the corner portions 52*c*, especially when receiving force in the width direction of the first housing 11. Furthermore, since the corner portions 52*c* extend in the same flat surface as the central portion 52*a*, the upper surface 21*a* of the end wall portion 21*c* is covered and protected in a larger area.

Each of the first concave bracket holding portions 26 is provided with groove-shaped first arm portion-receipt portions 26*a* configured to extend in the thickness and width directions of the first housing 11, and a connection portion-receipt opening portion 26*b* configured to be connected to the first arm portion-receipt portions 26*a* and to be opened in outer surface of the sidewall extension portion 21*b*. And the first arm portions 57 of the first reinforcing bracket 51 are received and held in the first arm portion-receipt portions 26*a*. The first board connection portions 56 are bent to be connected to the lower ends of the first arm portions 57 so that the free end thereof may turn outwardly in the width direction of the first housing 11. The first board connection portions 56 function as solder tail portions of the first reinforcing brackets 51, and lower surfaces thereof are formed to be substantially parallel with a mounting surface of the first housing 11 and are fixedly secured to fixing pads on the first board by means of soldering or the like.

Figure 5A:
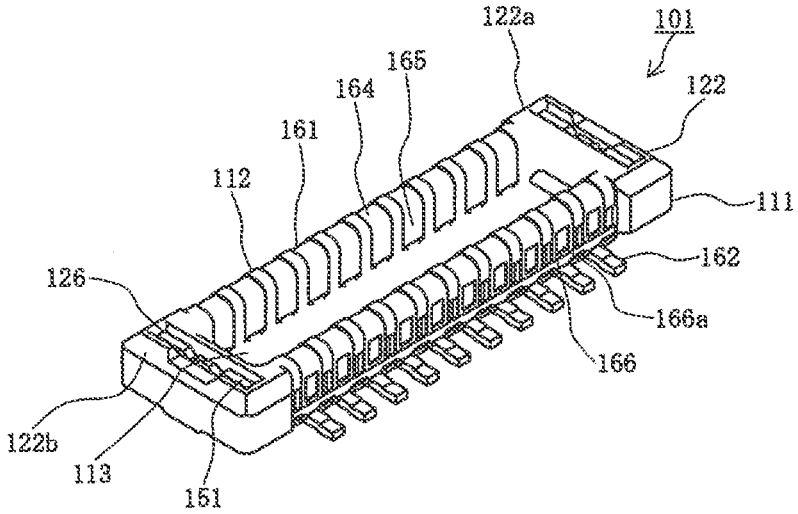

The second connector 101 includes a second housing 111 as a connector body integrally formed of an insulating material such as synthetic resin. As will be understood from the drawing figure, the second housing 111 is a generally rectangular parallelepiped member having a generally rectangular, thick plate-like shape. The second housing 111 has a dimension of about 8.0 mm in length, about 1.5 mm in width, and about 0.8 mm in thickness, and the dimension may be appropriately changed as required. Moreover, an elongated recessed cavity portion 113 configured to extend in the longitudinal direction of the second housing 111 and second protrusive convex portions 112 as an elongated protrusive convex portion configured to define the outer sides of the recessed cavity portion 113 and extend in the longitudinal direction of the second housing 111 are integrally formed on a side, i.e., a fitting face side (the upper side in FIG. 5A) of the second housing 111 where the first connector 1 is fitted. The second protrusive convex portions 112 are formed along both sides of the recessed cavity portion 113 and along both sides of the second housing 111. Moreover, second terminals 161 as a terminal are arranged in each of the second protrusive convex portions 112.

Figure 5B:
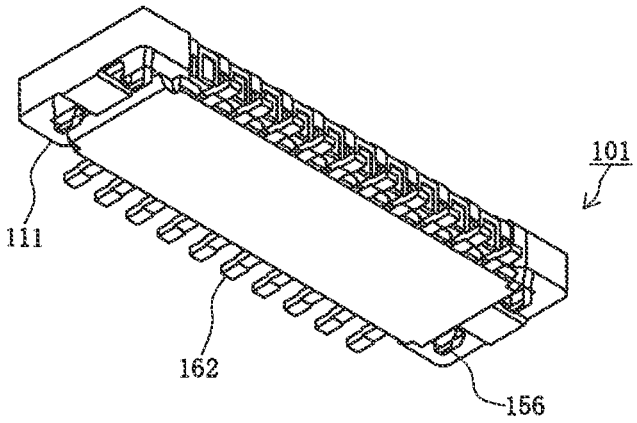

As illustrated in the drawing figure, the recessed cavity portion 113 is closed by a bottom portion at a surface thereof on a side, i.e., a mounting surface (the lower surface in FIG. 5B) where it is mounted on the second board. Moreover, although in the example illustrated in the drawing figure, the number of second protrusive convex portions 112 is two, it may be singular in number and the number thereof is not particularly limited. The recessed cavity portion 113 has a dimension of about 0.7 mm in width, for example, and the dimension thereof may be appropriately changed as required.

The second terminals 161 are an integral member formed by applying processing, e.g., punching and bending to a conductive metal plate. Each of the second terminals 161 is provided with a non-illustrated body portion, a tail portion 162 connected to a lower end of the body portion, a first contact portion 165 connected to an upper end of the body portion, a connection portion 164 connected to an upper end of the first contact portion 165, and a second contact portion 166 connected to an outer end of the connection portion 164. Moreover, second concave contact portions 166*a* configured to be engaged with the second contact portions 66 of the first terminals 61 are formed on the surface of the second contact portions 166.

The body portion is a portion which is held in a state where a perimeter thereof is surrounded by the second housing 111 and is not illustrated in FIG. 5. Moreover, the tail portions 162 are connected to the lower ends of the second terminals 161 which extend in the horizontal direction of the body portion, namely the width direction of the second housing 111, and are extended outwardly from the second housing 111 to be connected to terminal connection pads connected to a conductive trace on the second board by means of soldering or the like.

The first contact portions 165 are flat plate-like portions that are connected to the body portions so as to extend in the vertical direction, namely in the thickness direction of the second housing 111. The connection portions 164 are bent to be connected to the first contact portions 165 and extend outwardly in the width direction of the second housing 111. The second contact portions 166 are portions that are bent downwardly to be connected to the outer ends of the connection portions 164 so as to extend downwardly.

The second terminals 161 are integrated with the second housing 111 by means of over-molding. That is to say, the second housing 111 is formed by filling resin in a cavity of a mold having the second terminals 161 set therein. In this way, the second terminals 161 are integrally attached to the second housing 111 in a state where the body portions are buried in the second housing 111, and the surfaces of the first contact portions 165 and the connection portions 164, and the second contact portions 166 are exposed to the respective lateral surfaces of the second convex portions 112 and the fitting faces. In this case, the number of second terminals 161 arranged in the left and right sides of the second housing 111 is 10 with a pitch of about 0.4 mm, for example. Moreover, the pitch and the number of the second terminals 161 are appropriately changed.

Furthermore, second protrusive end portions 122 as a second fitting guide portion are arranged at both ends in the longitudinal direction of the second housing 111, respectively. Each of the second protrusive end portions 122 is a thick member that extends in the width direction of the second housing 111 and has both ends thereof connected to both ends in the longitudinal direction of the second protrusive convex portion 112, and an upper surface 122*a* thereof has a generally rectangular shape. In addition, slanting tapered surfaces 122*b* are connected to the side edges (the edges facing to the end in the longitudinal direction of the second housing 111 and the edges facing to the both ends in the width direction of the second housing 111) of the each upper surface 122*a*. Moreover, the second protrusive end portions 122 function as convex insertion portions which are inserted in the concave protrusive end portions 22 of the first protrusive end portions 21 of the first connector 1 in a state where the first connector 1 and the second connector 101 are engaged by fitting together. Furthermore, the tapered surfaces 122*b* function as guide portions for guiding the second protrusive end portion 122 into the corresponding concave protrusive end portion 22.

Furthermore, second reinforcing brackets 151 as a reinforcing bracket are attached to the second protrusive end portions 122. Specifically, each of the second reinforcing brackets 151 is received and held in a second concave bracket holding portion 126, which is formed in each of the second protrusive end portions 122 and has a slot shape extending in the width and the thickness directions of the second housing 111. In addition, in a state where being received in the second concave bracket holding portion 126, an upper end of the second reinforcing bracket 151 does not protrude above the upper surface 122*a* of the second protrusive end portions 122.

In the present embodiment, the second reinforcing bracket 151 is an integral member formed by applying processing, e.g., punching, to a metal plate (for example, about 0.2 mm in thickness), and generally has an elongated strip shape configured to extend in the width direction of the second housing 111. And the second reinforcing bracket 151 is provided with second board connection portions 156 protruding downwardly. Each of the second board connection portions 56 functions as a solder tail portion of the second reinforcing brackets 151, has a bottom surface configured to extend generally parallel to the mounting surface of the second housing 111, and is fixed to a fixing pad on the second board by means of soldering or the like.

In the present embodiment, the first connector 1 is assumed to be surface-mounted on the first board in a state where the tail portions 62 of the first terminals 61 are connected to a non-illustrated terminal connection pads connected to a conductive trace on the first board by means of soldering or the like and the first board connection portions 56 of the first reinforcing brackets 51 are connected to the fixing pads on the first board by means of soldering or the like.

Similarly, the second connector 101 is assumed to be surface-mounted on the second board in a state where the tail portions 162 of the second terminals 161 are connected to the non-illustrated terminal connection pads connected to a conductive trace on the second board by means of soldering or the like and the second board connection portions 156 of the second reinforcing brackets 151 are connected to the fixing pads on the second board by means of soldering or the like.

Herein, a description of a connector fitting operation will be provided assuming that an operator performs the operation by groping, since the first and second connectors 1, 101 are respectively mounted on the first and second boards with so large area that the operator cannot view the fitting faces of the first and second connectors 1, 101.

Figure 6:
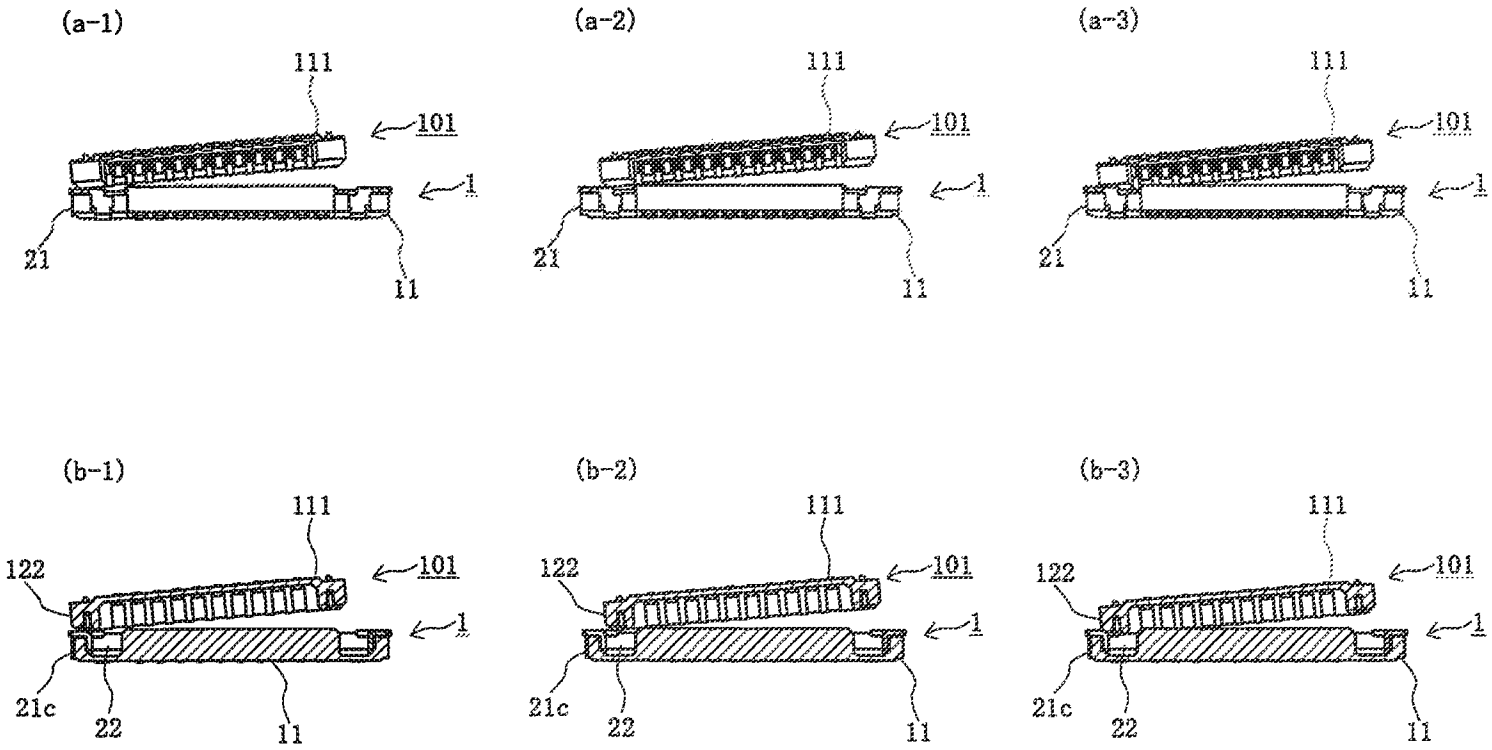
FIGS. 6(*a*-1)-(*a*-3) and 6(*b*-1)-(*b*-3) are views of a board-to-board connector according to the first embodiment of the Present Disclosure, illustrating examples of positional relationship of the first and second connectors in a fitting procedure of the board-to-board connector, in which FIGS. 6(*a*-1)-(*a*-3) are side views of a first to a third examples and FIGS. 6(*b*-1)-(*b*-3) are sectional side views corresponding to FIGS. 6(*a*-1)-(*a*-3)

First, the operator manipulates the connectors so that the fitting face of the first connector 1 opposes the fitting face of the second connector 101. When the operator moves the first connector 1 and/or the second connector 101 in a direction toward either one of the connectors, i.e., in the fitting direction, a part of the fitting face of the first connector 1 and a part of the fitting face of the second connector 101 abut each other. In this case, the first connector 1 and the second connector 101 cannot be in appropriate positional relationship as shown in FIGS. 6(*a*-1) to 6(*a*-3) and 6(*b*-1) to 6(*b*-3), since the operator cannot align them correctly by grouping. Furthermore, the first terminals 61 are assumed not to protrude above the fitting face of the first connector 1, and the second terminals 161 are assumed not to protrude above the fitting face of the second connector 101. So, in this state, the first terminals 61 and the second terminals 161 are separated and unconnected each other. Therefore, even if the operator makes the first connector 1 and the second connector 101 rub each other, the first terminals 61 and the second terminals 161 would be kept undamaged from mutual abutting.

In a state shown in FIGS. 6(*a*-1) and 6(*b*-1), the second connector is apart a lot from the first connector 1 in the longitudinal direction, and their fitting faces are not parallel with each other. In this state, when the operator moves the first connector 1 and/or the second connector 101 to the fitting direction, the second protrusive end portion 122 on the left side in the figure of the second connector 101 would abut against the end wall portion 21*c* of the first protrusive end portion 21 on the left side in the figure of the first connector 1, then the end wall portion 21*c* would receive a large pressing force in the fitting direction, e.g., downward direction in the figure, from the second protrusive end portion 122.

However, in the present embodiment, the first reinforcing brackets 51 are attached to the first protrusive end portion 21 so that the upper surfaces 21*a* of the end wall portions 21*c* are covered with the central portions 52*a* of the first body portions 52 of the first reinforcing brackets 51, and the first board connection portions 56 of the first reinforcing brackets 51 are secured to fixing pads on the first board. Accordingly, even if a large pressing force is applied from the second protrusive end portions 122, the force would be transmitted to the first board through the first board connection portions 56 from the central portions 52*a* of the first body portions 52 of the first reinforcing brackets 51, and would be hardly transmitted to the end wall portions 21*c*. Therefore, the end wall portions 21*c* may not get damaged or broken, either.

Figure 7:
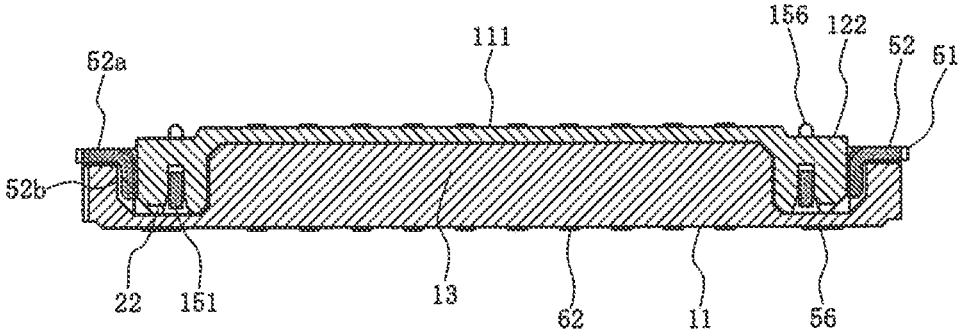
FIG. 7 is a sectional side view of the board-to-board connector of FIG. 6, illustrating a state where the fitting procedure is completed, taken along Arrow B-B.

Since, as shown typically in FIG. 7, each of the tongue piece portions 52*b*, which extend in the direction perpendicular to the extending direction of the central portions 52*a*, is connected to the inside edges of the central portion 52*a*, each of the first body portions 52 of the first reinforcing brackets 51 has an approximately L-like sectional shape so as to have a large modulus of section and a high strength. Accordingly, however large the pressing force is, which is generated by the operator and is transmitted to the end wall portions 21*c* of the first protrusive end portions 21 through the second protrusive end portions 122, it would be hardly transmitted to the end wall portions 21*c* since the first body portion 52 of the first reinforcing bracket 51 could receive it effectively. Therefore, even if a large pressing force is applied, the end wall portions 21*c* may not get damaged or broken, either.

In a state shown in FIGS. 6(*a*-3) and 6(*b*-3), the second connector is apart a little from the first connector 1 in the longitudinal direction, and their fitting faces are not parallel with each other. In this state, when the operator moves the second connector 101 in the left direction in the figure against the first connector 1, the second protrusive end portion 122 of the left side in the figure of the second connector 101 would abut against the inside surface 21*d* of the end wall portion 21*c* of the first protrusive end portion 21 on the left side in the figure of the first connector 1, then the end wall portion 21*c* would receive a large pressing force facing the end in the longitudinal direction, e.g., the left facing direction in the figure, from the second protrusive end portion 122.

However, in the present embodiment, the inside surfaces 21*d* of the end wall portions 21*c* are covered with the tongue piece portions 52*b* connected to the central portions 52*a* of the first body portions 52 of the first reinforcing brackets 51, and the first board connection portions 56 of the first reinforcing brackets 51 are secured to fixing pads on the first board. Accordingly, even if a large pressing force facing the end in the longitudinal direction is applied from the second protrusive end portions 122, the force would be transmitted to the first board through the first board connection portions 56 from the tongue piece portions 52*b* of the first body portions 52 of the first reinforcing brackets 51, and would be hardly transmitted to the end wall portions 21*c*. Therefore, the end wall portions 21*c* may not get damaged or broken, either.

As described above, each of the first body portions 52 of the first reinforcing brackets 51 has an approximately L-like sectional shape so as to have a large modulus of section and a high strength. Accordingly, however large the pressing force facing the end in the longitudinal direction is, which is generated by the operator and is transmitted to the end wall portions 21*c* of the first protrusive end portions 21 through the second protrusive end portions 122, it would be hardly transmitted to the end wall portions 21*c* since the first body portion 52 of the first reinforcing bracket 51 could receive it effectively. Therefore, even if a large pressing force is applied, the end wall portions 21*c* may not get damaged or broken, either.

In a state shown in FIGS. 6(*a*-2) and 6(*b*-2), the second connector is hardly apart from the first connector 1 in the longitudinal direction, and their fitting faces are not parallel with each other. In this state, when the operator moves the first connector 1 and/or the second connector 101 to the fitting direction, the second protrusive end portion 122 on the left side in the figure of the second connector 101 would be inserted aslant into the concave protrusive end portion 22 on the left side in the figure of the first connector 1, then the end wall portion 21*c* of the first protrusive end portion 21 on the left side in the figure of the first connector 1 would receive a large pressing force aslant in the fitting direction from the second protrusive end portion 122.

However, in the present embodiment, the upper surfaces 21*a* of the end wall portions 21*c* are covered with the central portions 52*a* of the first body portions 52 of the first reinforcing brackets 51, the inside surfaces 21*d* of the end wall portions 21*c* are covered with the tongue piece portions 52*b* connected to the central portions 52*a* of the first body portions 52 of the first reinforcing brackets 51, and the first board connection portions 56 of the first reinforcing brackets 51 are secured to fixing pads on the first board. Accordingly, even if a large slant pressing force is applied from the second protrusive end portions 122, the force would be transmitted to the first board through the first board connection portions 56 from the central portions 52*a* of the first body portions 52 of the first reinforcing brackets 51, and would be hardly transmitted to the end wall portions 21*c*. Therefore, the end wall portions 21*c* may not get damaged or broken, either.

As described above, each of the first body portions 52 of the first reinforcing brackets 51 has an approximately L-like sectional shape so as to have a large modulus of section and a high strength. Accordingly, however large the pressing force is, which is generated by the operator and is transmitted to the end wall portions 21*c* of the first protrusive end portions 21 through the second protrusive end portions 122, it would be hardly transmitted to the end wall portions 21*c* since the first body portion 52 of the first reinforcing bracket 51 could receive it effectively. Therefore, even if a large pressing force is applied, the end wall portions 21*c* may not get damaged or broken, either.

Figure 8:
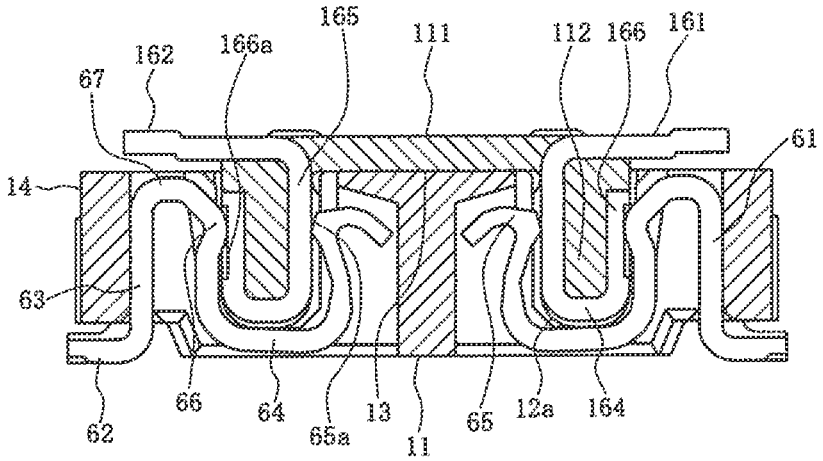
FIG. 8 is a cross sectional view of the board-to-board connector of FIG. 6, illustrating a state where the fitting procedure is completed, taken along Arrow C-C.
Figure 9A:
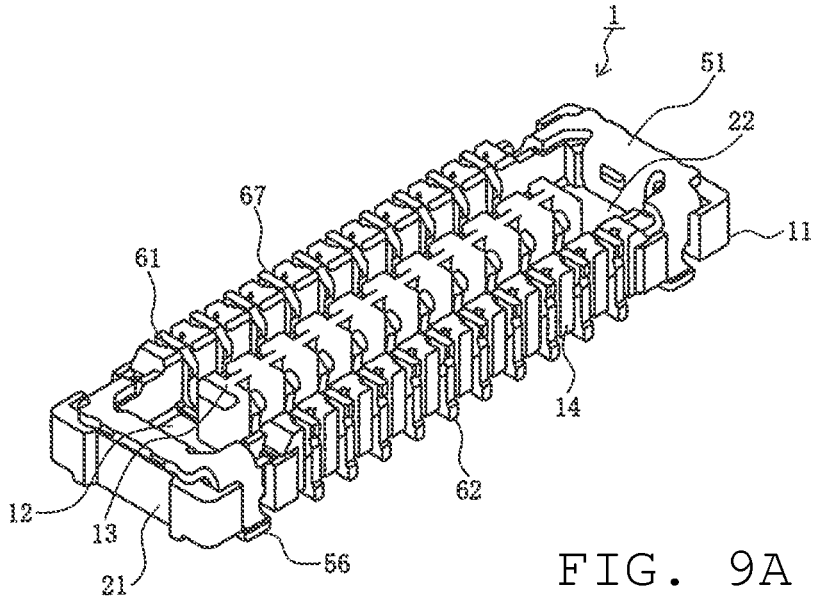
Figure 9B:
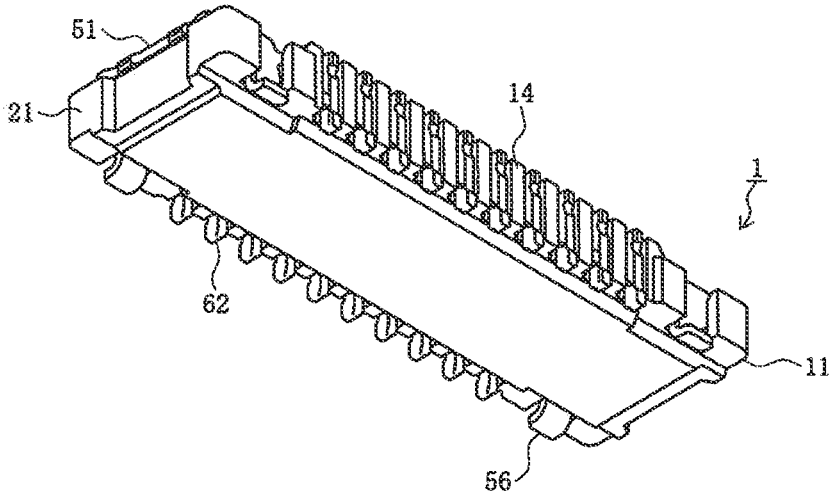

In a state where the fitting procedure of the first and second connectors 1, 101 has been finished at last, as shown in FIG. 7, each of the second protrusive end portions 122 of the second connector 101 is received in the corresponding concave protrusive end portion 22 of the first connector 1, respectively. Moreover, as shown in FIG. 8, the left and right second protrusive convex portions 112 of the second connector 101 are received in the left and right recessed groove portions 12*a* of the first connector 1. And the second terminals 161 of the second connector 101 are inserted to be positioned between the first contact portions 65 and the second contact portions 66 of the first terminals 61, so that the first contact portions 65 of the first terminals 61 are brought into contact with the first contact portions 165 of the second terminals 161, and the second contact portions 66 of the first terminals 61 are brought into contact with the second contact portions 166 of the second terminals 161.

As a result, the conductive trace connected to the terminal connection pads on the first board being connected to the tail portions 62 of the first terminals 61 are electrically connected to the conductive trace connected to the terminal connection pads on the second board being connected to the tail portions 162 of the second terminals 161.

Moreover, the second contact portions 66 of the first terminals 61 are engaged with the second concave contact portions 166*a* of the second terminals 161. As a result, the first connector 1 and the second connector 101 are locked.

In the present embodiment, any reinforcing bracket equivalent to the first reinforcing bracket 51 is not arranged in the second protrusive end portions 122 of the second connector 101. The reason for this is that the second protrusive end portions 122 are supposed to be of high strength and not be damaged or broken either even when receiving some pressing force, since the second protrusive end portions 122 have smaller dimension in the width direction and larger dimension in the longitudinal direction of the second housing 111 than the end wall portion 21*c* of the first connector 1, e.g., are thick and short wall-like members, as compared to the end wall portion 21*c* of the first connector 1. Though, reinforcing brackets equivalent to the first reinforcing brackets 51 can be arranged in the second protrusive end portions 122 of the second connector 101, if they are necessary as the second protrusive end portions 122 are supposed to get damaged or broken.

Moreover, in the first reinforcing bracket 51 according to the present embodiment, although the tongue piece portion 52*b* is connected to the inside edge of the central portion 52*a*, any member equivalent to the tongue piece portion 52*b* is not connected to the outside edge of the central portion 52*a*. The reason for this is that the length of the first connector 1 would be longer and a bigger mounting space would be needed on the first board, if any member equivalent to the tongue piece portion 52*b* is connected to the outside edge of the central portion 52*a*. Though members equivalent to the tongue piece portion 52*b* may be also connected to the outside edge of the central portion 52*a* if needed. In this case, the first body portions 52 would have an inverted C-like sectional shape so as to have a larger modulus of section and a higher strength.

Furthermore, the left and right first board connection portions 56 of the first reinforcing brackets 51 according to the present embodiment are arranged so as to be aligned with the tail portions 62 of a plurality of terminals 61, which are aligned on the left and right sides of the first housing 11. The reason for this is that the inspection of connections between the first board connection portions 56 and the fixing pads on the first board would be conducted easily, since this inspection could be conducted simultaneously with that of connections between the tail portions 62 and the terminal connection pads on the first board. Moreover, the tail portions 62 would not be removed from the terminal connection pads even when being pressed by external force, since the first board connection portions 56 would share the force together with the tail portions 62.

In addition, the positions of the first board connection portions 56 may be changed appropriately if needed. For example, the first board connection portions 56 may be positioned outside the end wall portion 21*c*. However, in this case, it may become difficult to supply parts in the connector manufacturing process. Moreover, when external force is applied to the first connector 1 mounted on the first board, the tail portions 62 may be removed from the terminal connection pads. Furthermore, the dimension in the longitudinal direction of the first connector 1 may be larger.

As described above, in the present embodiment, the first reinforcing brackets 51 are attached to the first protrusive end portions 21 of the first connector 1. And each of the first reinforcing bracket 51 includes the first body portion 52, which is configured to extend in the width direction of the first housing 11 and includes the central portion 52*a* covering at least a part of the upper surface 21*a* of the end wall portion 21*c* and the tongue piece portion 52*b* covering at least a part of the inside surface 21*d* of the end wall portion 21*c*, and the first board connection portions 56, which are connected to the first body portion 52 and the free ends of which are fixed to the board. Accordingly, if the pressing force generated by the operator is applied, the end wall portions 21*c* of the first protrusive end portions 21, which are covered with the first body portions 52 of the first reinforcing brackets 51, may not get damaged or broken, either. Therefore, even if the fitting operation is performed by groping, the end wall portion 21*c* of the first protrusive end portion 21 may not get damaged or broken either, then, the operability of fitting operation would be improved and the board-to-board connector of high credibility could be provided.

Subsequently, a description of a second embodiment of the Present Disclosure will be provided herein below in details. Components having the same structures as those of the first embodiment will be denoted by the same reference numerals and descriptions thereof will be omitted. In addition, the descriptions of the operations and effects as those of the first embodiment also will be omitted.

In the present embodiment, each of the first terminal-receiving outside cavities 15*b* in the first housing 11 of the first connector 1 is formed in a groove shape so that it does not cover only the inside surface of the side wall portion 14 but continuously straddle the inside, the upper and the outside surfaces thereof. And the first terminal-receiving outside cavities 15*b* and the first terminal-receiving inside cavities 15*a* are connected with each other at a bottom surface of the recessed groove portion 12*a* and are integral with each other, in the same manner as in the first embodiment.

Moreover, the first terminals 61 according to the present embodiment are formed integrally by applying punching to a conductive metallic plate. In addition, in the same manner as in the first embodiment, each of the first terminals 61 according to the present embodiment is also provided with the holding portion 63, the tail portion 62 connected to the lower end of the holding portion 63, the upper connection portion 67 connected to the upper end of the holding portion 63, the second contact portion 66 as the second contacting convex portion formed in the vicinity of the inner end of the upper connection portion 67, the lower connection portion 64 connected to the second contact portion 66, the first contact portion 65 formed in the vicinity of a free end of the lower connection portion 64, and the first contact portion 65*a* formed in the first contact portion 65.

Figure 10:
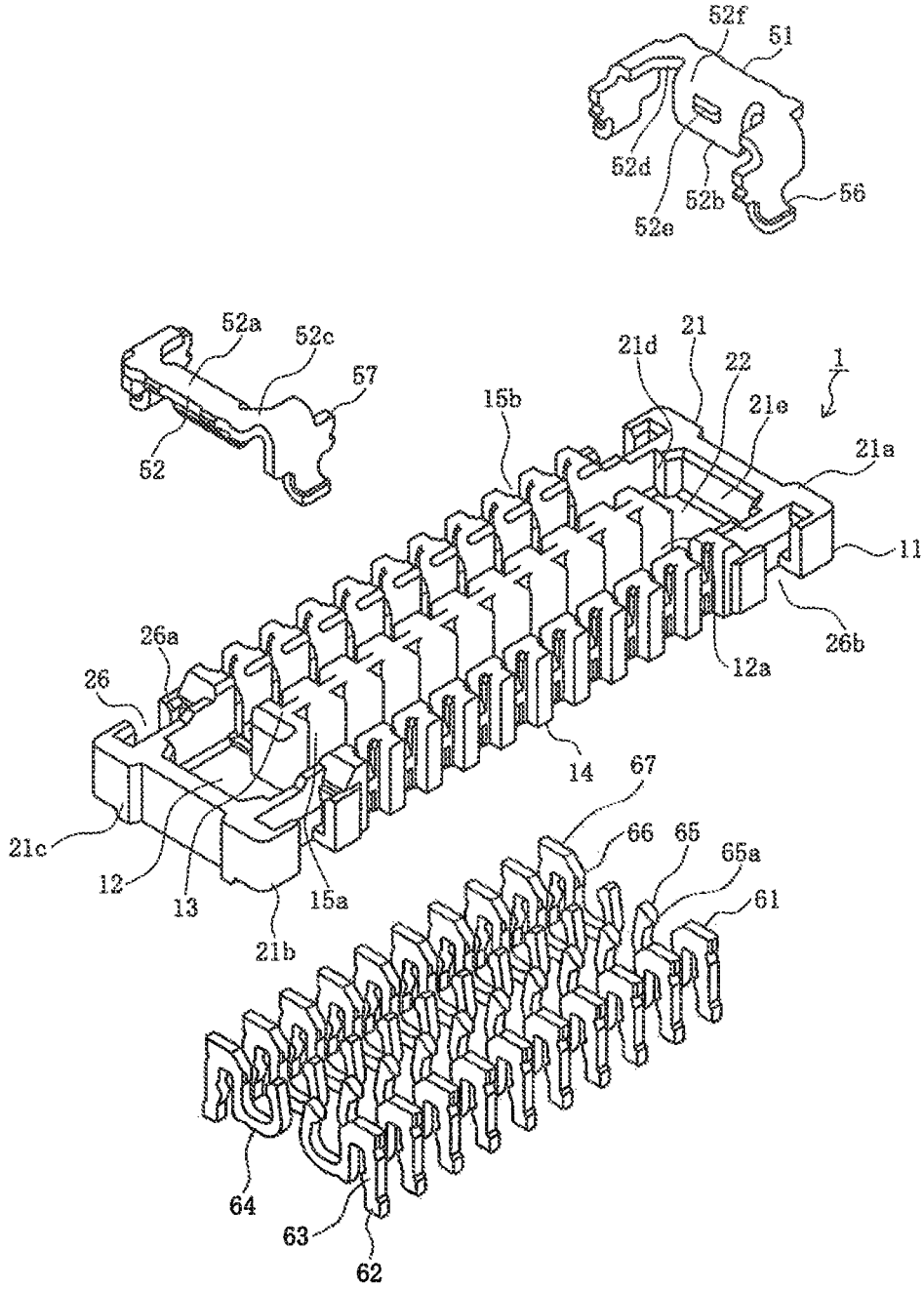
FIG. 10 is an exploded view of the connector of FIG. 9A.
Figure 11A:
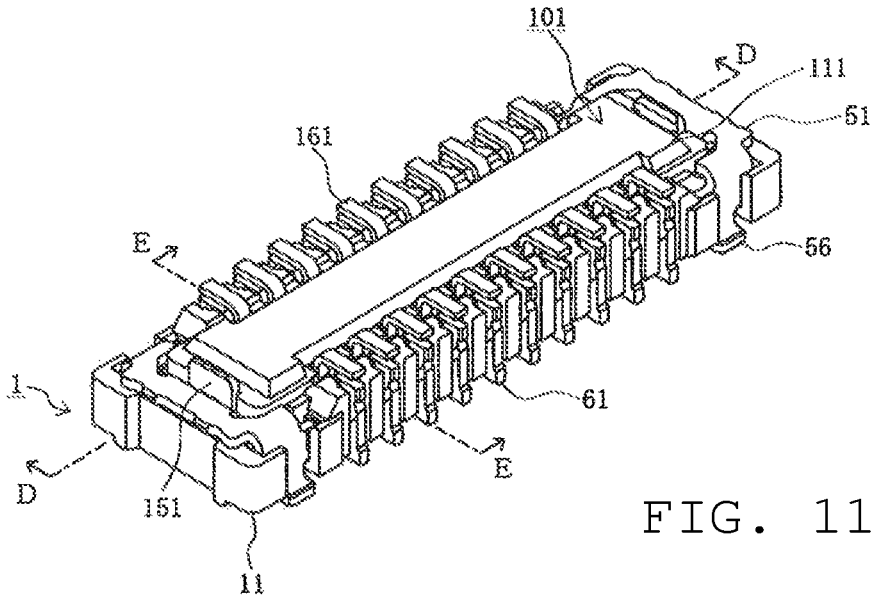
Figure 11B:
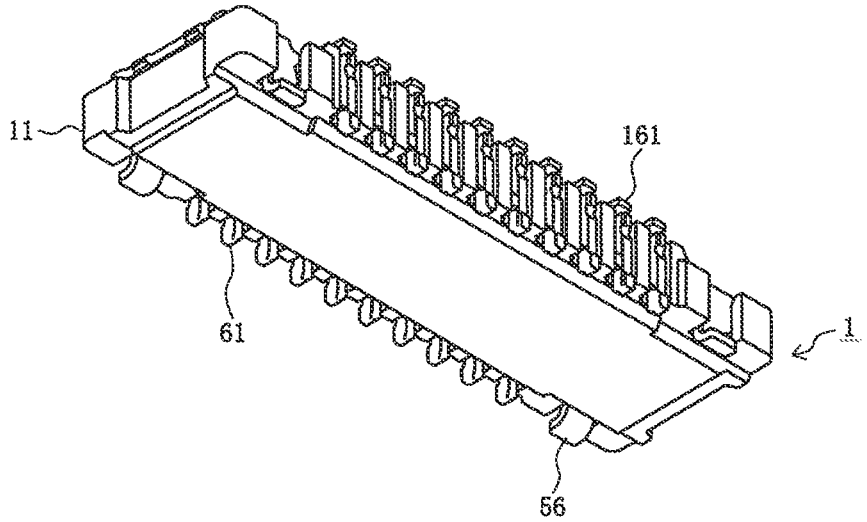

In the present embodiment, the first terminals 61 are fitted into the first terminal receiving cavities 15 from the fitting face side (the upper side in FIG. 10) to be fixedly secured to the first housing 11, when the holding portions 63 are received in the portions formed in the outside surface of the side wall portion 14 in the first terminal-receiving outside cavities 15*b*, the upper connection portions 67 are received in the portions formed in the upper surface of the side wall portion 14 in the first terminal-receiving outside cavities 15*b*, and the portion for connecting the vicinity of an inner end of the upper connection portion 67 and the lower connection portion 64 are received in the portions formed in the inside surface of the side wall portion 14 in the first terminal-receiving outside cavities 15*b*. In this state, that is, a state where the first terminals 61 are mounted in the first housing 11, the first contact portions 65 and the second contact portions 66 are positioned on both left and right sides of the recessed groove portion 12*a* so as to oppose each other. Moreover, the gap between the opposing ones of the first contact portions 65 and the second contact portions 66 is elastically changeable. That is, when the second terminals 161 of the second connector 101 are inserted to be positioned between the first contact portions 65 and the second contact portions 66, the gap between the first contact portions 65 and the second contact portions 66 is elastically increased.

The first reinforcing bracket 51 according to the present embodiment is provided with a first locking portion 52*e* formed in the tongue piece portion 52*b*, and a slope portion 52*f* formed in the connection section between an upper end of the tongue piece portion 52*b* and the central portion 52*a*.

The first locking portion 52*e* is a protrusive convex portion protruding inwardly from an inside surface (the surface facing to the center in the longitudinal direction of the first housing 11) of the tongue piece portion 52*b*. In a state where the first connector 1 and the second connector 101 are engaged by fitting together, the first locking portion 52*e* is engaged with a later-described second locking portions 152*e* of the second reinforcing bracket 151 of the second connector 101. In addition, a fitting face side part of the first locking portion 52*e* is preferably formed slanting.

The slope portion 52*f* is a portion formed for connecting the inside surface of the tongue piece portion 52*b* and the upper surface of the central portion 52*a* via a gentle incline, and may be either a flat surface or a curved surface. Since the corners in connection section between the inside surface of the tongue piece portion 52*b* and the upper surface of the central portion 52*a* have been removed by the slope portion 52*f*, the second protrusive end portion 122 of the second connector 101 could be inserted smoothly in the concave protrusive end portion 22 of the first connector 1, when the first connector 1 and the second connector 101 are fitting together.

In the present embodiment, the first board connection portions 56 of first reinforcing brackets 51 may be connected to either fixing pads on the first board or terminal connection pads connected to a ground line on the first board by means of soldering or the like.

Other structures in the first connector 1 according to the present embodiment are the same as those according to the first embodiment and, therefore, the descriptions thereof have been omitted.

In the present embodiment, the second housing 111 of the second connector 101 is provided with second terminal receiving cavities 15, each which is formed in a groove shape so as to straddle continuously the inside, the upper and the outside surfaces of the second protrusive convex portion 112.

The first terminals 161 according to the present embodiment are an integral member formed, by applying e.g., punching and bending to a conductive metallic plate. Each of the first terminals 161 is provided with a holding portion 163, the tail portion 162 connected to a lower end of the holding portion 163, the connection portion 164 connected to an upper end of the holding portion 163, the first contact portion 165 connected to the inner end of the connection portion 164, and the second contact portion 166 formed in the outside surface of the holding portion 163. In addition, a second contacting convex portion 166*b* which is engaged with the second contact portion 66 of the first terminal 61 is formed in the upper part of the second contact portion 166.

Figure 12A:
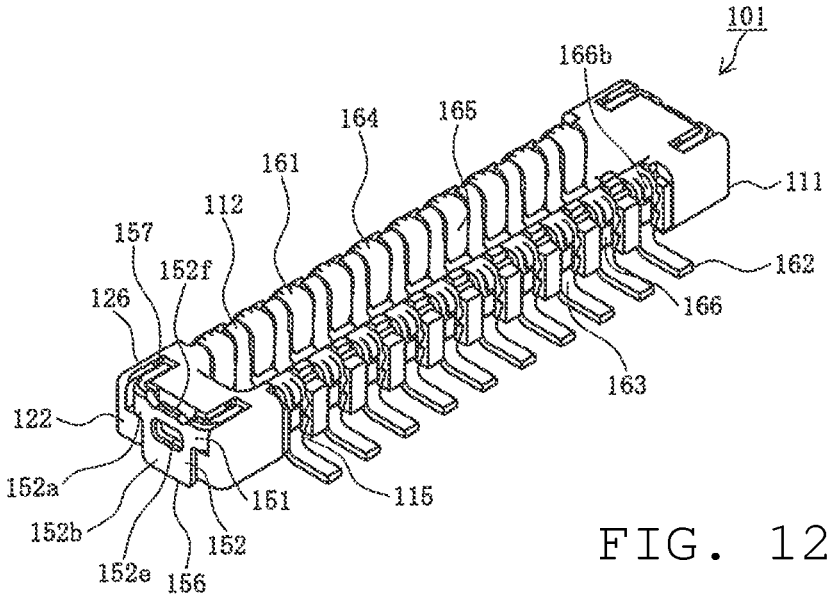
Figure 12B:
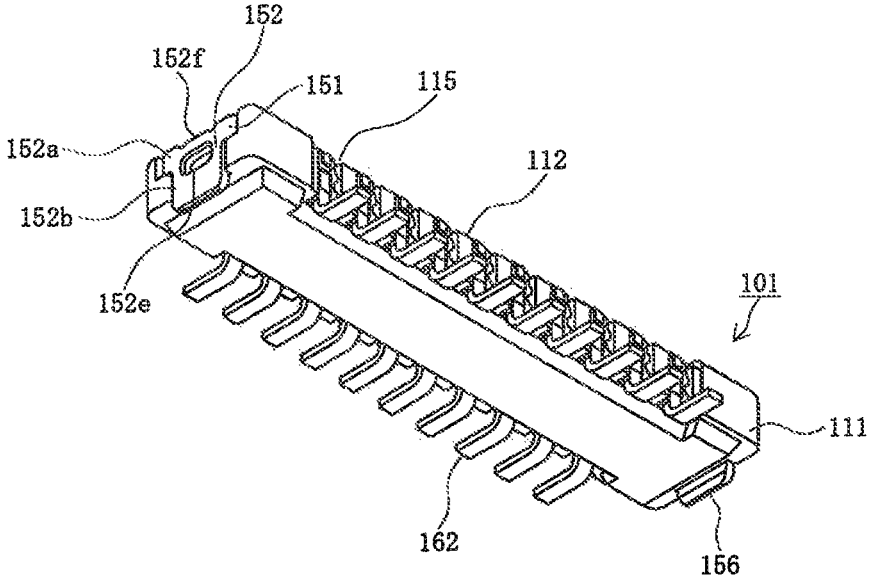

In the present embodiment, the second terminals 161 are fitted into the second terminal receiving cavities 115 from the fitting face side (the upper side in FIG. 12) to be fixedly secured to the second housing 111, when the holding portions 163 are received in the portion formed on the outside surface of the second protrusive convex portion 112 in the second terminal receiving cavities 115 and are clamped by the side walls. In this state, that is, a state where the second terminals 161 are mounted in the second housing 111, the surfaces of the first contact portions 165, the connection portion 164 and the second contact portions 166 are exposed on the surfaces of the second convex portions 112 and the fitting face.

In the present embodiment, the second reinforcing brackets 151 are an integral member formed by applying processing, e.g., punching and bending, to a metal plate (for example, about 0.1 mm in thickness). Each of the second reinforcing brackets 151 is provided with a second body portion 152, as a body portion, which is generally configured to extend in the width direction of the second housing 111, second arm portions 157, as a holding portion, which are configured to be bent to be connected to both left and right ends of the second body portion 152 and extend in the longitudinal direction of the second housing 111 to be held in the second housing 111, and a second board connection portion 156, as a board connection portion, which is connected to a lower end of each of the second body portions 152.

The second reinforcing brackets 151 are attached to the second protrusive end portion 122 so that the second body portions 152 may cover at least a part of outside surfaces (the surfaces of both ends in the longitudinal direction of the second housing 111) of the second protrusive end portions 122. A pair of second concave bracket holding portions 126, each of which has a slit shape and extends toward the center in the longitudinal direction of the second housing 111 from the outside surface, are formed in each of the second protrusive end portions 122. The second arm portions 157 are received and held in the second concave bracket holding portions 126.

Each of the first body portion 152 is provided with a central portion 152*a*, which generally has an elongated strip shape and is configured to extend in the width direction of the second housing 111 linearly and parallel to the outside surfaces of the second protrusive end portion 122, and a tongue piece portion 152*b*, which is configured to extend downwardly from the center part of the central portion 152*a*, i.e., toward the mounting face. In addition, the lower end of the tongue piece portion 152*b* functions as the second board connection portion 156.

Moreover, each of the tongue piece portions 152*b* is provided with a second locking portion 152*e*. The second locking portions 152*e* are concave portions formed in the tongue piece portions 152*b*, more in details, are openings penetrating the tongue piece portions 152*b* in the plate thickness direction, and engage with the first locking portions 52*e* of the first reinforcing brackets 51 provided to the first connector 1, when the first connector 1 and the second connector 101 engage each other by fitting.

Furthermore, the upper end in the center part of each of the central portions 152*a* functions as a fitting contact portion 152*f*. Since the fitting contact portions 152*f* abut against the central portions 52*a* and/or the slope portions 52*f* of the first reinforcing brackets 51 of the first connector 1 when the first connector 1 and the second connector 101 engage each other by fitting, the second protrusive end portions 122 would not get damaged, and the second protrusive end portions 122 of the second connector 101 could be inserted smoothly into the concave protrusive end portions 22 of the first connector 1.

In the present embodiment, the second board connection portion 156 of second reinforcing brackets 151 may be connected to either fixing pads on the second board or terminal connection pads connected to a ground line on the second board by means of soldering or the like.

Other structures in the second connector 101 according to the present embodiment are the same as those in the first embodiment and, therefore, the descriptions thereof have been omitted.

An operation of fitting the first connector 1 and the second connector 101 to be engaged with each other is the same as that in the first embodiment and, therefore, the descriptions thereof will be omitted.

Figure 13:
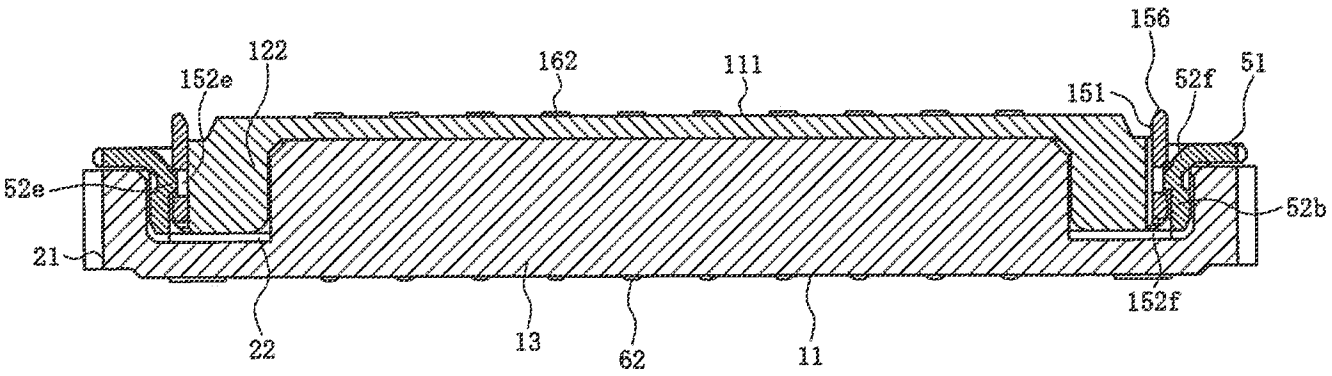
FIG. 13 is a sectional side view of a board-to-board connector according to the second embodiment of the Present Disclosure, illustrating a state where a fitting procedure is completed, taken along Arrow D-D.

When the engagement between the first connector 1 and the second connector 101 has been finished, as shown in FIG. 13, each of the second protrusive end portions 122 of the second connector 101 is received in the corresponding concave protrusive end portion 22 of the first connector 1, respectively.

And, the first locking portions 52*e* provided to the first reinforcing brackets 51 of the first connector 1 are engaged with the second locking portions 152*e* provided to the second reinforcing brackets 151 of the second connector 101.

In this case, the portion including the tip of the first locking portion 52*e* is inserted into the second locking portion 152*e* from the outside of the tongue piece portion 152*b* of the second reinforcing bracket 151, but, preferably, may not reach the inside surface of the tongue piece portion 152*b*. And the inside surface of the tongue piece portion 52*b* of the first reinforcing bracket 51 preferably may not abut against the outside surface of the tongue piece portion 152*b* of the second reinforcing bracket 151. That is, it is preferable that some clearance exists between the inside surface of the tongue piece portion 52*b* of the first reinforcing bracket 51 and the outside surface of the tongue piece portion 152*b* of the second reinforcing bracket 151. Furthermore, the side end opposite to the fitting face (the bottom end in FIG. 13) of the first locking portion 52*e* of the first reinforcing bracket 51 preferably may not abut against the fitting face side end (the bottom end in FIG. 13) of the second locking portion 152*e* of the second reinforcing bracket 151. That is, it is preferable that some clearance exists in the fitting direction between the first locking portion 52*e* of the first reinforcing bracket 51 and the second locking portion 152*e* of the second reinforcing bracket 151.

When the first locking portions 52*e* of the first reinforcing brackets 51 are engaged with the second locking portion 152*e* of the second reinforcing bracket 151, a clicking feeling could be generated and the operator could perceive the clicking feeling with the finger, etc. In the present embodiment, as described above, the clicking felling would not be impeded, since some clearance preferably exists between the first reinforcing brackets 51 and the second reinforcing bracket 151 in a state when the engagement between the first locking portion 52*e* of the first reinforcing bracket 51 and the second locking portion 152*e* of the second reinforcing bracket 151 has been completed. That is, the operator who performs fitting operation of the first connector 1 and the second connector 101 with the hands could perceive the click feeling certainly.

Moreover, since the first locking portion 52*e* of the first reinforcing bracket 51 is engaged with the second locking portion 152*e* of the second reinforcing bracket 151, the first reinforcing bracket 51 and the second reinforcing bracket 151 are locked, and the engagement between the first connector 1 and the second connector 101 would be prevented surely. That is, since the disengagement of the first locking portion 52*e* of the first reinforcing bracket 51 and the second locking portion 152*e* of the second reinforcing bracket 151 is needed in order to detach and separate the first connector 1 from the second connector 101, a large removal force should be needed. Therefore, the engagement between the first connector 1 and the second connector 101 would not be released unnecessarily.

Furthermore, since the slope portion 52*f* is formed in the section connecting the upper end of the tongue piece portion 52*b* of the first reinforcing bracket 51 and the central portion 52*a*, the second protrusive end portion 122 of the second connector 101 could be inserted smoothly into the concave protrusive end portions 22 of the first connector 1, when the first connector 1 and the second connector 101 are engaged together by fitting. Moreover, since the fitting face side portion of the first locking portion 52*e* is preferably inclined, the first locking portion 52*e* could be inserted smoothly into the second locking portion 152*e*. Furthermore, since the fitting contact portion 152*f* of the second reinforcing bracket 151 abuts against the central portion 52*a* and/or the slope portion 52*f* of the first reinforcing bracket 51, the second protrusive end portion 122 of the second connector 101 could not get damaged and could be inserted smoothly into the concave protrusive end portions 22 of the first connector 1. Therefore, the operator who performs fitting operation of the first connector 1 and the second connector 101 with the hands could perform the operation easily without exerting any large force.

Figure 14:
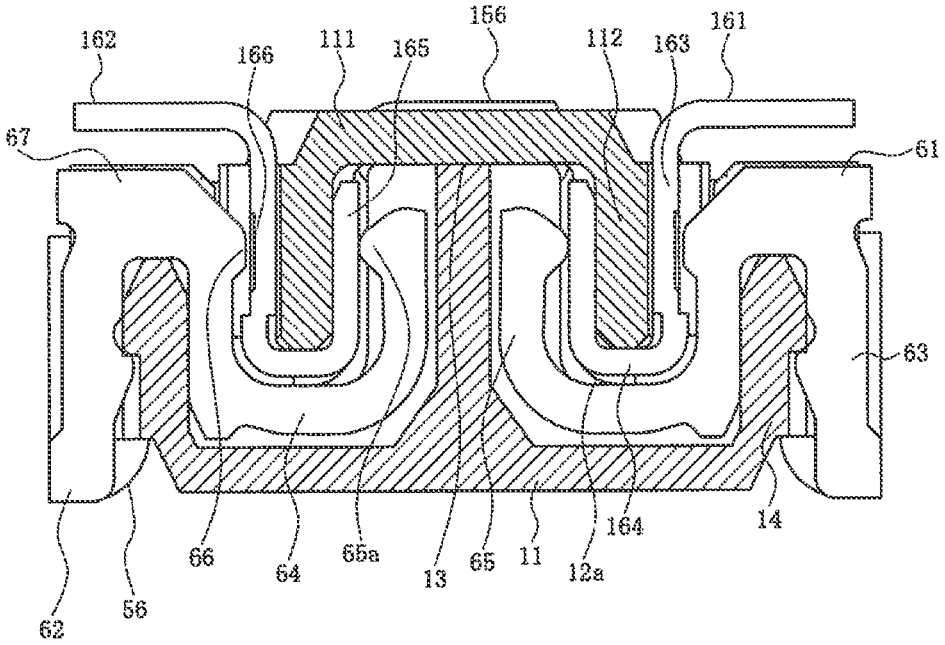
FIG. 14 is a cross sectional view of the board-to-board connector of FIG. 13, illustrating a state where the fitting procedure is completed, taken along Arrow E-E.
Figure 15A:
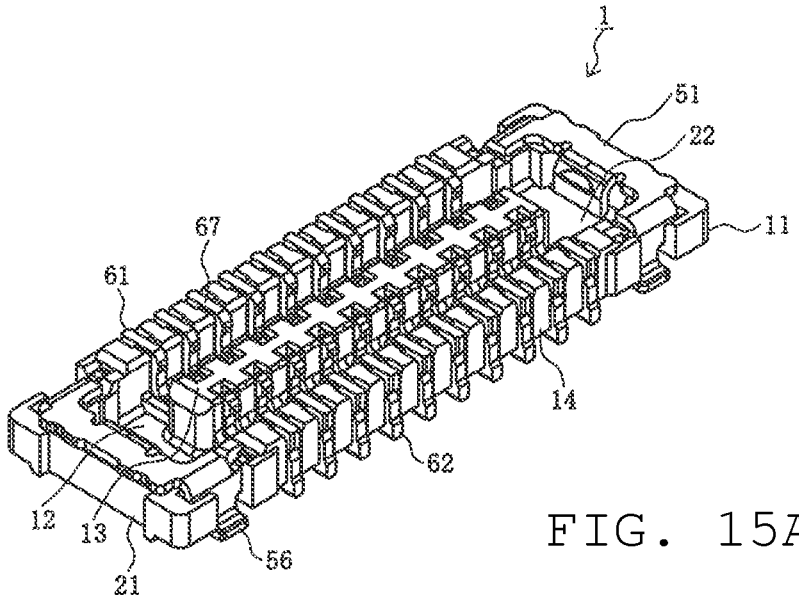
Figure 15B:
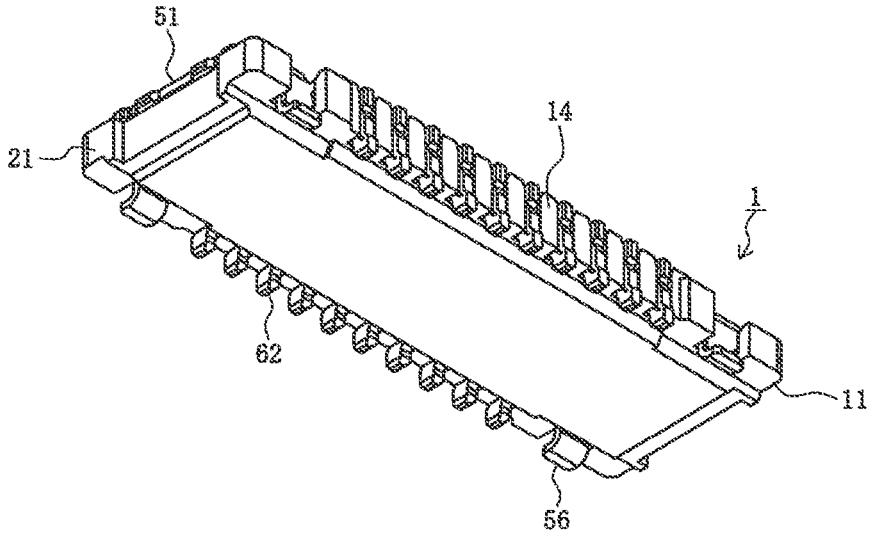
Figure 16:
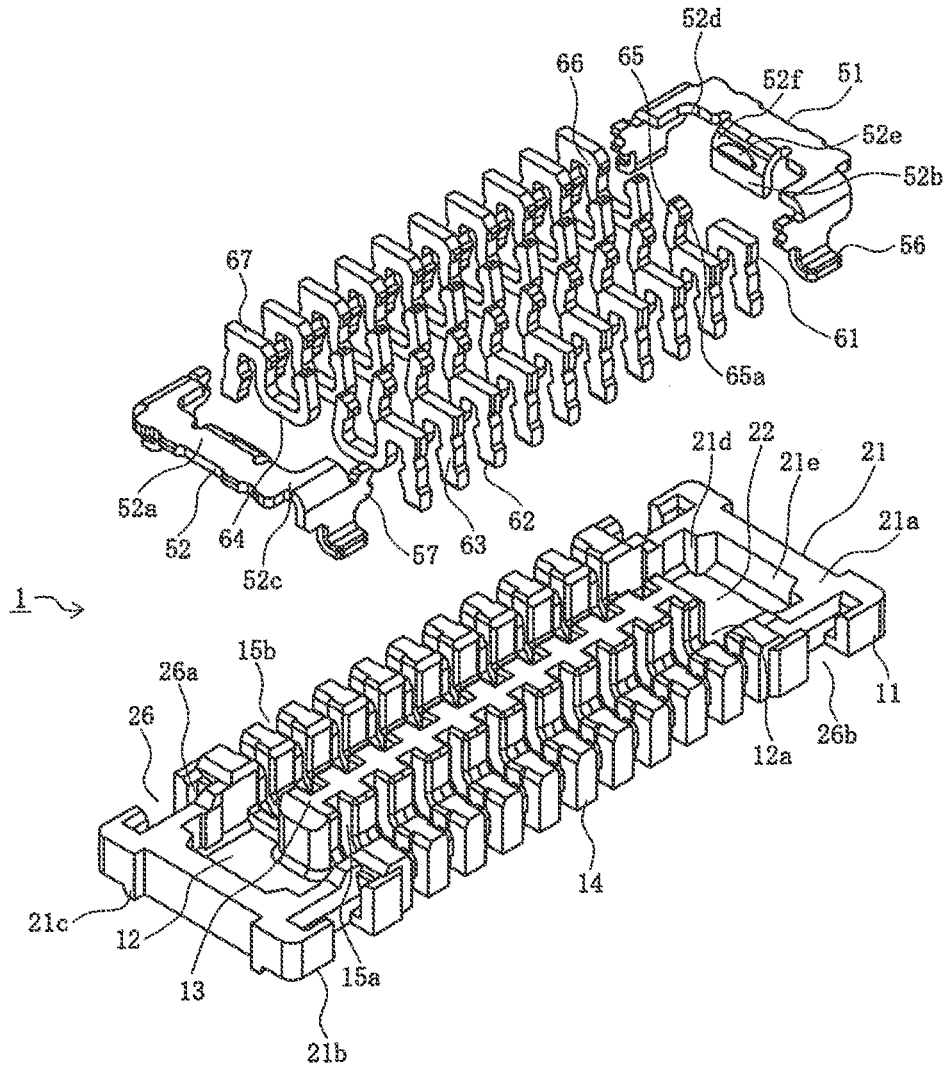
FIG. 16 is an exploded view of the connector of FIG. 15A.
Figure 17A:
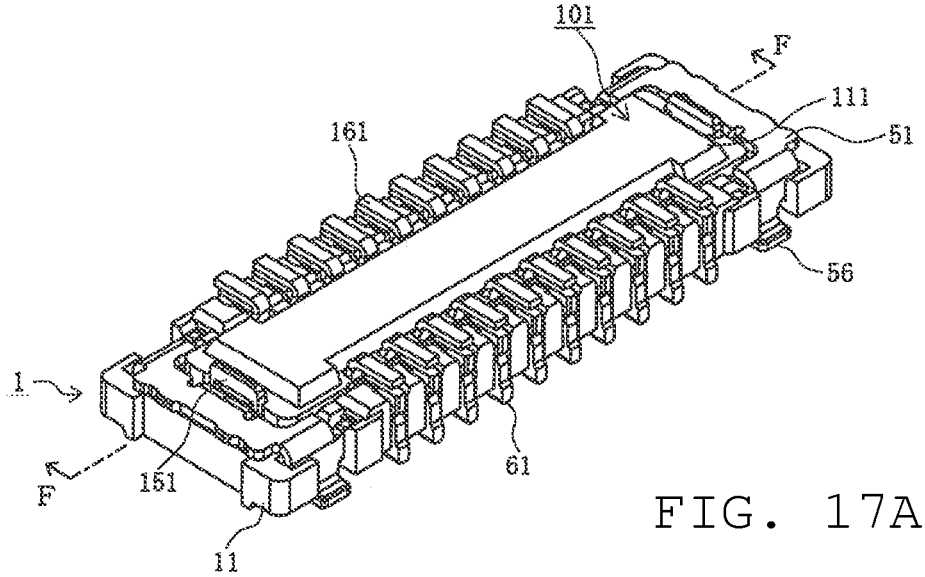
Figure 17B:
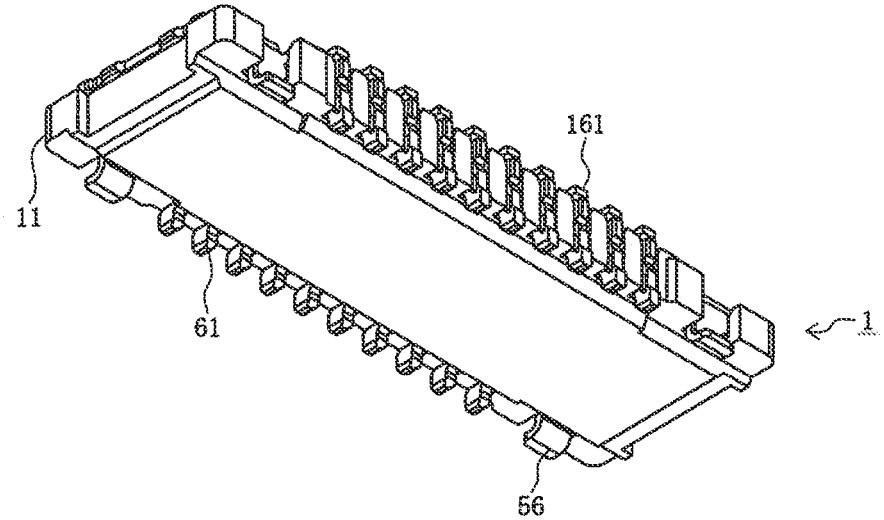
Figure 18A:
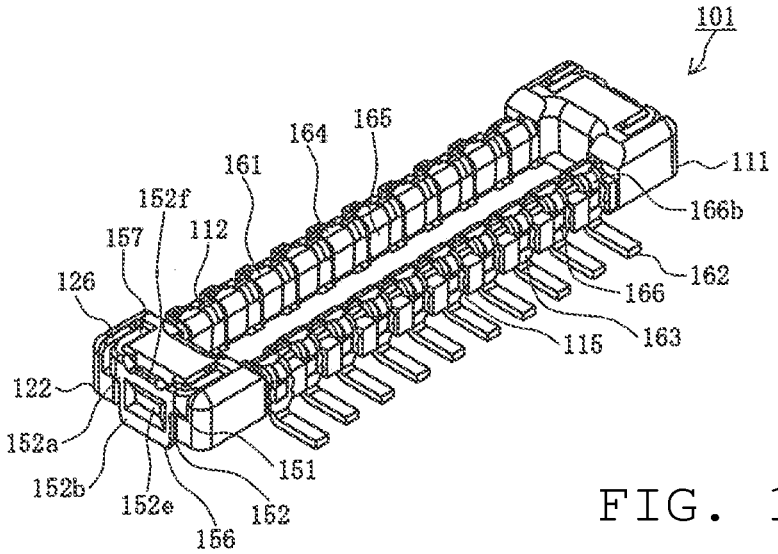
Figure 18B:
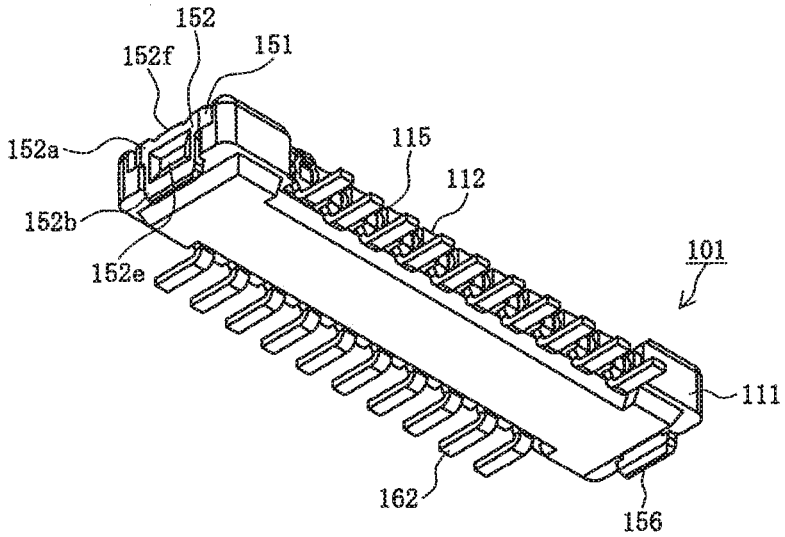

When the engagement between the first connector 1 and the second connector 101 has been finished, as shown in FIG. 14, the left and right second protrusive convex portions 112 of the second connector 101 are received in the left and right recessed groove portions 12*a* of the first connector 1. And each of the second terminals 161 of the second connector 101 is inserted between the first contact portion 65 and the second contact portion 66 of each first terminal 61, the first contact portion 65 of each first terminal 61 and the first contact portion 165 of each second terminal 161 contact each other, and the second contact portion 66 of each first terminal 61 and the second contact portion 166 of each second terminal 161 contact each other.

As a result, the conductive trace connected to the terminal connection pad on the first board, which the tail portion 62 of the first terminal 61 is connected to, and the conductive trace connected to the terminal connection pad on the second board, which the tail portion 162 of the second terminal 161 is connected to, become electrically connected. In addition, if the first board connection portions 56 of the first reinforcing brackets 51 and the second board connection portions 156 of the second reinforcing bracket 151 are connected to the terminal connection pad connected to the ground lines on the first board and the second board by means of soldering or the like, respectively, the first terminals 61 and the second terminals 161 which are used as ground terminals could be omitted.

In the present embodiment, although the case where the first locking portions 52*e* are convex and the second locking portions 152*e* are concave has been described, the case where the first locking portions 52*e* are concave and the second locking portions 152*e* are convex could be accepted alternatively.

Other operations and effects according to the present embodiment are the same as those according to the first embodiment and, therefore, the descriptions thereof have been omitted.

Subsequently, a description of a third embodiment of the Present Disclosure will be provided herein below in details. Components having the same structures as those of the first and the second embodiments will be denoted by the same reference numerals and descriptions thereof will be omitted. In addition, the descriptions of the operations and effects as those of the first and the second embodiments also will be omitted.

In the present embodiment, each of the first terminal-receiving outside cavities 15*b* in the first housing 11 of the first connector 1 is formed in a groove shape, in the same manner as in the second embodiment, so that it does not cover only the inside surface of the side wall portion 14 but continuously straddle the inside, the upper and the outside surfaces thereof. Moreover, the first terminals 61 according to the present embodiment are formed integrally by applying punching to a conductive metallic plate, in the same manner as in the second embodiment.

The first reinforcing bracket 51 according to the present embodiment, in the same manner as in the second embodiment, is provided with a first locking portion 52*e* formed in the tongue piece portion 52*b*, and a slope portion 52*f* formed in the connection section between an upper end of the tongue piece portion 52*b* and the central portion 52*a*.

Other structures in the first connector 1 according to the present embodiment are the same as those according to the second embodiment and, therefore, the descriptions thereof have been omitted.

In the present embodiment, the second housing 111 of the second connector 101, in the same manner as in the second embodiment, is provided with second terminal receiving cavities 115, each which is formed in a groove shape so as to straddle continuously the inside, the upper and the outside surfaces of the second protrusive convex portion 112. The second terminals 161, in the same manner as in the second embodiment, are fitted into the second terminal receiving cavities 115 from the fitting face side to be fixedly secured to the second housing 111, when the holding portions 163 are received in the portion formed on the outside surface of the second protrusive convex portion 112 in the second terminal receiving cavities 115 and are clamped by the side walls.

Moreover, the second reinforcing brackets 151 according to the present embodiment, in the same manner as in the second embodiment, are attached to the second protrusive end portion 122 so that the second body portions 152 may cover at least a part of outside surfaces of the second protrusive end portions 122, and have tongue piece portions 152*b* with second locking portions 152*e* formed therein. Though, the second locking portions 152*e* according to the present embodiment are not penetrating the tongue piece portions 152*b* in the plate thickness direction, but are subsidence parts formed through depressing the outside surfaces of the tongue piece portions 152*b*. That is, the second locking portions 152*e* according to the present embodiment are concave portions, but are not openings penetrating the tongue piece portions 152*b* in the plate thickness direction.

Other structures in the second connector 101 according to the present embodiment are the same as those in the second embodiment and, therefore, the descriptions thereof have been omitted.

An operation of fitting the first connector 1 and the second connector 101 to be engaged with each other is the same as that in the first embodiment and, therefore, the descriptions thereof will be omitted.

Figure 19:
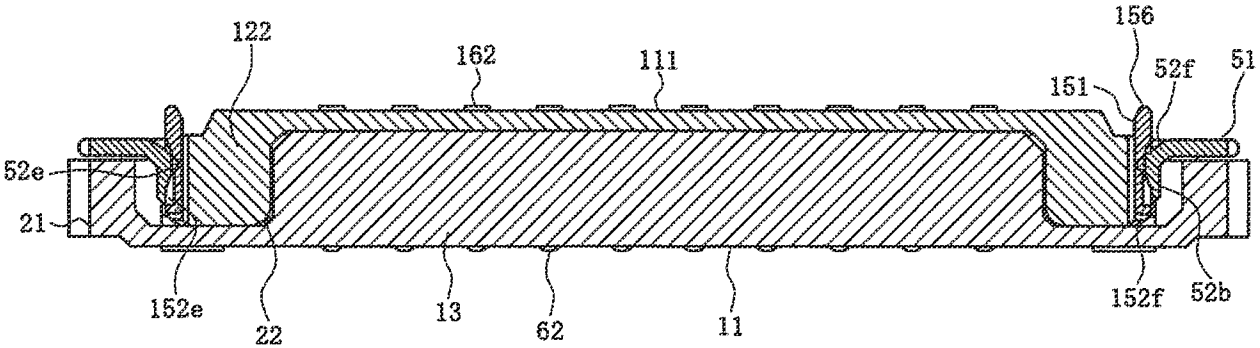
FIG. 19 is a sectional side view of a board-to-board connector according to the third embodiment of the Present Disclosure, illustrating a state where the fitting procedure is completed, taken along Arrow F-F.
Figure 20:
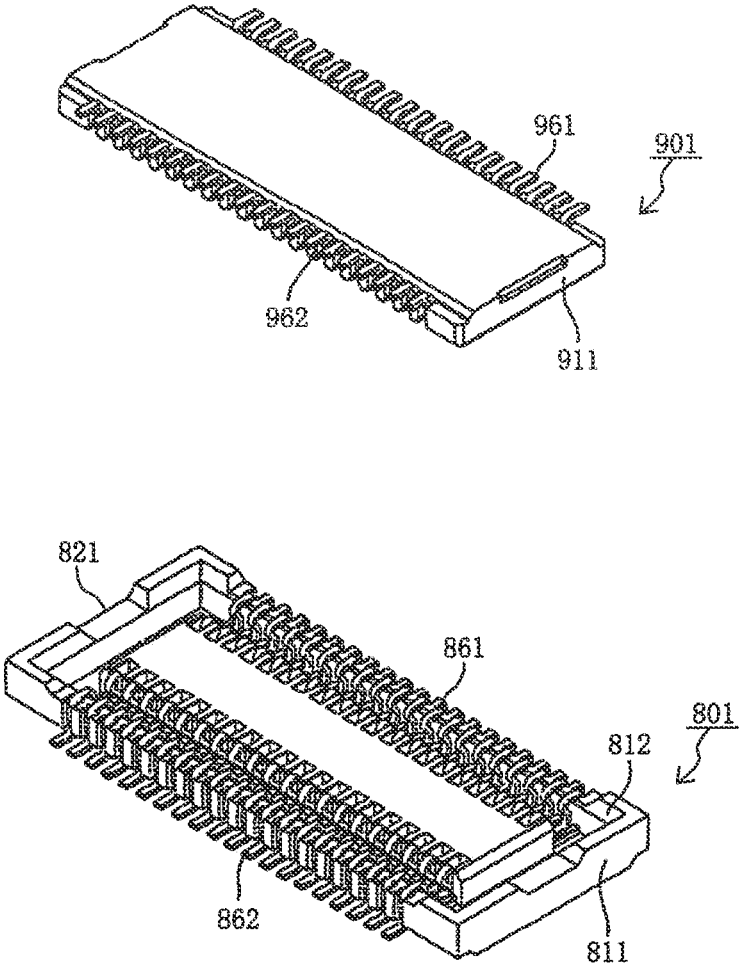
Prior art FIG. 20
FIG. 20 is a perspective view of a conventional board-to-board connector, illustrating a state before a board-to-board connector is engaged together by fitting.

When the engagement between the first connector 1 and the second connector 101 has been finished, as shown in FIG. 19, each of the second protrusive end portions 122 of the second connector 101 is received in the corresponding concave protrusive end portion 22 of the first connector 1, respectively.

And, the first locking portions 52*e* provided to the first reinforcing brackets 51 of the first connector 1 are engaged with the second locking portions 152*e* provided to the second reinforcing brackets 151 of the second connector 101. Specifically, the portion including the tip of the first locking portion 52*e* is inserted into the second locking portion 152*e* from the outside of the tongue piece portion 152*b* of the second reinforcing bracket 151, and abuts against the bottom surface of the second locking portion 152*e*.

As described above, in the present embodiment, the tip of the first locking portion 52*e* abuts against the bottom surface of the second locking portion 152*e*, when the first locking portions 52*e* of the first reinforcing brackets 51 are engaged with the second locking portions 152*e* of the second reinforcing brackets 151. Accordingly, friction would be generated between the tip of the first locking portion 52*e* and the bottom surface of the second locking portion 152*e*, when the first reinforcing brackets 51 and the second reinforcing brackets 151 are displaced relatively in the direction of disengagement. That is, higher removal force should be applied for disengaging and separating the first connector 1 and the second connector 101, since it would be necessary not only to disengage the first locking portion 52*e* of the first reinforcing bracket 51 and the second locking portion 152*e* of the second reinforcing bracket 151 but also to overcome the friction between the tip of the first locking portion 52*e* and the bottom surface of the second locking portion 152*e*. Therefore, the engagement between the first connector 1 and the second connector 101 would not be released unnecessarily.

In the present embodiment, although the case where the first locking portions 52*e* are convex and the second locking portions 152*e* are concave has been described, in the same manner as in the second embodiment, the case where the first locking portions 52*e* are concave and the second locking portions 152*e* are convex could be accepted alternatively.

Other operations and effects according to the present embodiment are the same as those according to the second embodiment and, therefore, the descriptions thereof have been omitted.

While a preferred embodiment of the Present Disclosure is shown and described, it is envisioned that those skilled in the art may devise various modifications without departing from the spirit and scope of the foregoing Description and the appended Claims.

What is claimed is:

1. A board-to-board connector, the board-to-board connector comprising:

a first connector, the first connector including first terminals, a first housing and first reinforcing brackets, the first housing including first fitting guide portions, the first fitting guide portions being formed at both ends in the longitudinal direction of the first housing, one first reinforcing bracket being attached to each first fitting guide portion; and a second connector, the second connector including second terminals and a second housing, the second connectors configured to contact the first terminals, the second housing including second fitting guide portions, the second fitting guide portions being formed at both ends in the longitudinal direction of the second housing and configured to engage the first fitting guide portions.

2. The board-to-board connector of claim 1, wherein the first fitting guide portions include concave portions, into which the second fitting guide portion are inserted, and end wall portions, extending in the thickness direction of the first housing, inside surfaces of the end wall portions defining outside ends in the longitudinal direction of the first housing in the concave portions.

3. The board-to-board connector of claim 2, wherein the first reinforcing brackets are metallic.

4. The board-to-board connector of claim 3, wherein each first reinforcing bracket includes a body portion, extending in the width direction of the first housing, and board connection portions, connected to the body portion and fixed to a board at a free end, the body portion including a central portion, covering at least a part of fitting side face of the end wall portion, and a tongue piece portion, connected to the central portion and covering at least a part of inside surface of the end wall portion.

5. The board-to-board connector of claim 4, wherein the central portion and the tongue piece portion extend in mutually perpendicular directions.

6. The board-to-board connector of claim 5, wherein the body portion has modulus of section of an approximate L-shape.

7. The board-to-board connector of claim 6, wherein the first reinforcing bracket includes holding portions, the holding portions being connected to the body portion via corner portions, the corner portions extending aslant toward the center in the longitudinal direction of the first housing from the central portion.

8. The board-to-board connector of claim 7, wherein the holding portions extend in the thickness direction of the first housing, and are held by the first housing.

9. The board-to-board connector of claim 8, wherein the board connection portions are connected to one end of the holding portions.

10. The board-to-board connector of claim 9, wherein each first terminal includes a tail portion, the tail portion being connected to a conductive trace of the board.

11. The board-to-board connector of claim 10, wherein each board connection portion is aligned in a straight line with the tail portions.

12. The board-to-board connector of claim 11, wherein each first reinforcing bracket further includes a slope portion, the slope portion being formed in connection section between the central section and the tongue piece portion.

13. The board-to-board connector of claim 12, wherein each first reinforcing bracket further includes a first locking portion, the first locking portion being formed in the tongue piece portion.

14. The board-to-board connector of claim 13, further including second reinforcing brackets, each second reinforcing bracket being attached to one second fitting guide portion.

15. The board-to-board connector of claim 14, wherein each second reinforcing bracket includes a tongue piece portion, covering at least a part of outside surfaces of the second fitting guide portion, and a second locking portion, formed on the tongue piece portion.

16. The board-to-board connector of claim 15, wherein, when the first connector engages the second connector, the first locking portion engages the second locking portion.

17. The board-to-board connector of claim 16, wherein, when the first connector engages the second connector, clearance exists between the first reinforcing bracket and the second reinforcing bracket.

18. The board-to-board connector of claim 17, wherein one of the first locking portion and the second locking portion is convex, and the other is concave.

19. The board-to-board connector of claim 16, wherein, when the first connector engages the second connector, the first locking portion and the second locking portion abut each other.

20. The board-to-board connector of claim 19, wherein one of the first locking portion and the second locking portion is convex, and the other is concave.

* * * * *